US012798855B2

(12) United States Patent
Cheng et al.

(10) Patent No.: US 12,798,855 B2
(45) Date of Patent: Nov. 17, 2026

(54) PACKAGING SYSTEM FOR STORING A FLUID SUBSTANCE AND ITS PUMP DISPENSER

(71) Applicant: The Procter & Gamble Company, Cincinnati, OH (US)

(72) Inventors: Zhan Cheng, Beijing (CN); Lu Yao, Beijing (CN)

(73) Assignee: The Procter & Gamble Company, Cincinnati, OH (US)

( * ) Notice: Subject to any disclaimer, the term of this patent is extended or adjusted under 35 U.S.C. 154(b) by 168 days.

(21) Appl. No.: 18/672,465

(22) Filed: May 23, 2024

(65) Prior Publication Data

US 2024/0391674 A1 Nov. 28, 2024

(30) Foreign Application Priority Data

May 23, 2023 (WO) ..... PCT/CN2023/095814

(51) Int. Cl.
*B65D 75/58* (2006.01)
*A47K 5/12* (2006.01)
(Continued)

(52) U.S. Cl.
CPC ..... *B65D 75/5883* (2013.01); *A47K 5/1205* (2013.01); *B65D 77/06* (2013.01); *B65D 83/76* (2025.01)

(58) Field of Classification Search
CPC .... B65D 75/5883; B65D 83/76; B65D 77/06; B65D 83/005; A47K 5/1205; B05B 11/0038; B05B 11/026
See application file for complete search history.

(56) References Cited

U.S. PATENT DOCUMENTS 3,245,582 A * 4/1966 Roth ..... B65D 83/62 222/488
4,275,055 A 6/1981 Nachtigal et al.
(Continued)

FOREIGN PATENT DOCUMENTS

CA 2762589 A1 6/2013
FR 2984131 A1 6/2013
(Continued)

OTHER PUBLICATIONS

PCT Search Report and Written Opinion for PCT/CN2023/095814 dated Dec. 15, 2023, 11 pages.

*Primary Examiner* — Paul R Durand
*Assistant Examiner* — Randall A Gruby
(74) *Attorney, Agent, or Firm* — Alexandra S. Anoff

(57) ABSTRACT

A packaging system for storing a fluid substance that includes a pump dispenser. The pump dispenser has a pump assembly, a flexible pouch, and a connecting shell. The flexible pouch contains the fluid substance to be dispensed. The connecting shell has a cavity and an upper portion and a lower portion. The pump assembly includes an actuator having a cavity therein and a closure connected to the actuator. The housing of the pump assembly is secured at the upper portion of the connecting shell. The cavity of the connecting shell and the outer surface of the housing of the pump assembly form an air chamber or the cavity of the housing forms an air chamber. The pump assembly is removably engaged with the flexible pouch in an airtight sealing manner such that when the actuator is pushed down and released by a user, air is balanced in the air chamber by the air ventilating hole and air is not balanced in the flexible pouch.

15 Claims, 19 Drawing Sheets

(51) Int. Cl.
*B65D 77/06* (2006.01)
*B65D 83/76* (2006.01)

(56) References Cited

U.S. PATENT DOCUMENTS 5,156,299 A * 10/1992 De Caluwe ..... B05B 11/026 220/4.23
5,474,212 A * 12/1995 Ichikawa ..... B05B 11/0038 222/105
5,769,274 A * 6/1998 Behar ..... B05B 11/1047 222/105
5,926,953 A * 7/1999 Behar ..... B05B 15/30 29/428
6,142,344 A * 11/2000 Kai ..... B65D 83/771 222/105
6,510,965 B1 * 1/2003 Decottignies ..... B05B 11/026 222/105
7,481,334 B2 * 1/2009 Arghyris ..... B05B 11/1074 222/137
9,101,948 B2 * 8/2015 Baron ..... B05B 11/1045
9,132,944 B2 * 9/2015 Schick ..... B29C 66/221
9,573,151 B1 * 2/2017 Miller ..... B05B 11/026
10,370,237 B2 * 8/2019 Blackburn ..... B67D 1/0004
10,435,207 B2 * 10/2019 Gerbaulet ..... B65D 75/5883
10,518,279 B2 * 12/2019 Okude ..... B05B 11/0054
10,675,646 B2 * 6/2020 Toh ..... B05B 11/1047
10,737,285 B2 * 8/2020 Toh ..... B05B 11/0054
11,014,106 B2 * 5/2021 Tortosa Maroto ..... B65D 77/06
11,628,458 B2 * 4/2023 Gass ..... B05B 11/1047 222/105
12,127,721 B1 * 10/2024 Park ..... A47K 5/12
12,150,606 B2 * 11/2024 Ciavarella ..... A47K 5/1217
2001/0032864 A1 * 10/2001 Shepherd ..... B05B 11/0037 222/321.5
2006/0243749 A1 * 11/2006 Robertson ..... B05B 11/0037 222/321.5
2010/0115024 A1 5/2010 Song
2010/0252573 A1 * 10/2010 Hetmaniok ..... B05B 11/0054 222/105
2024/0375843 A1 * 11/2024 Miyatani ..... B65D 77/06
2024/0391674 A1 * 11/2024 Cheng ..... B05B 11/026
2026/0215628 A1 * 7/2026 Blank ..... A47K 5/1205

FOREIGN PATENT DOCUMENTS

JP 4352384 B2 8/2009
JP 2015067324 A 4/2015
JP 6463315 B2 1/2019
JP 2021084647 A 6/2021
WO 2014050373 A1 4/2014

* cited by examiner

PACKAGING SYSTEM FOR STORING A FLUID SUBSTANCE AND ITS PUMP DISPENSER

FIELD OF THE INVENTION

The present application generally relates to a packaging system for storing a fluid substance comprising a pump dispenser. The pump dispenser comprises a pump assembly, a flexible pouch and a connecting shell. Optionally, the packaging system may further comprise an outer case for storing the pump dispenser and the flexible pouch.

BACKGROUND OF THE INVENTION

Conventionally, pouches containing shampoos, liquid detergents, cosmetics, and the like are known. The pouches can be manufactured inexpensively, and therefore are convenient as disposable containers.

Packaging systems with a docking frame, a pump dispenser, and a flexible pouch are also known. The consumer typically only replaces the disposable pouch with a new one and continues reusing the outer case and the pump dispenser, see for instance U.S. Pat. No. 5,474,212 A. However, when replacing with a new flexible pouch, the pouch change can often be messy. For example, the pump dispenser including a dip tube needs to be removed from the pouch to be disposed. Product dripping can occur from the dip tube or from the spout of the pouch, which is undesired by the consumer. Also, when inserting the dip tube into a new flexible pouch, contamination might occur with the previous product from the dip tube to the product of the new flexible pouch.

Hence, there is a need for providing an improved holistic packaging dispenser that is more convenient and reliable. The holistic packaging dispenser shall avoid any product contamination in the flexible pouch when changing the flexible pouch.

Product residues often remain in the flexible pouch to be disposed. All the product cannot be dispensed from the flexible pouch due to the dip tube length and position within the pouch.

There is a need to provide a pump dispenser that allows draining any remaining product residue from the flexible pouch at the end of dispensing usage.

There is a need to provide a packaging system with convenient connecting solutions between the pump assembly and the flexible pouch. The packaging system shall allow replacing the flexible pouch in lesser steps or in a more convenient manner.

SUMMARY OF THE INVENTION

A packaging system 1 for storing a fluid substance F is provided and comprises a pump dispenser 100, wherein the pump dispenser 100 comprises a pump assembly 50, a flexible pouch 60 and a connecting shell 30; wherein the flexible pouch 60 contains a fluid substance F to be dispensed, wherein the flexible pouch 60 has a spout 61; wherein the spout 61 is a sleeve having inner and outer surfaces (611, 612); wherein the connecting shell 30 has a cavity therein, wherein the connecting shell 30 has an upper portion 310 and a lower portion 320; wherein the pump assembly 50 includes an actuator 10 having a cavity therein; and a closure 20 connected to the actuator 10; wherein the pump assembly 50 has an housing 51 having an outer surface 510 and a lower end 520; wherein the housing 51 of the pump assembly 50 is secured at the upper portion 310 of the connecting shell 30, wherein the cavity of the connecting shell 30 and the outer surface 510 of the housing 51 of the pump assembly 50 form an air chamber 330 or wherein the cavity of the housing 51' forms an air chamber 513'; wherein the housing 51 of the pump assembly 50 includes an air ventilating hole (511, 511'); wherein the housing 51 of the pump assembly 50 has a port 56 at the lower end 520 of the housing 51; wherein the lower portion 320 of the connecting shell 30 is removably engaged with the outer surface 612 of the spout 61 of the flexible pouch 60, and characterized in that the pump assembly 50 is removably engaged with the flexible pouch 60 in an airtight sealing manner; such that when the actuator 10 is pushed down and released by a user, air is balanced in the air chamber (330, 513') by the air ventilating hole (511, 511') and air is not balanced in the flexible pouch 60, wherein the flexible pouch 60 is airtight and/or gradually vacuumed, over dispensing usage.

The packaging system 1 may further comprise an outer case 110 for storing the pump dispenser 100 and the flexible pouch 60.

A pump dispenser 100 is provided and comprises a pump assembly 50, a flexible pouch 60 and a connecting shell 30; wherein the flexible pouch 60 contains a fluid substance F to be dispensed, wherein the flexible pouch 60 has a spout 61; wherein the spout 61 is a sleeve having inner and outer surfaces (611, 612); wherein the connecting shell 30 has a cavity therein, wherein the connecting shell 30 has an upper portion 310 and a lower portion 320; wherein the pump assembly 50 includes an actuator 10 having a cavity therein; and a closure 20 connected to the actuator 10; wherein the pump assembly 50 has an housing 51 having an outer surface 510 and a lower end 520; wherein the housing 51 of the pump assembly 50 is secured at the upper portion 310 of the connecting shell 30, wherein the cavity of the connecting shell 30 and the outer surface 510 of the housing 51 of the pump assembly 50 form an air chamber 330 or wherein the cavity of the housing 51' forms an air chamber 513'; wherein the housing 51 of the pump assembly 50 includes an air ventilating hole (511, 511'); wherein the housing 51 of the pump assembly 50 has a port 56 at the lower end 520 of the housing 51; wherein the lower portion 320 of the connecting shell 30 is removably engaged with the outer surface 612 of the spout 61 of the flexible pouch 60, and characterized in that the pump assembly 50 is removably engaged with the flexible pouch 60 in an airtight sealing manner; such that when the actuator 10 is pushed down and released by a user, air is balanced in the air chamber (330, 513') by the air ventilating hole (511, 511') and air is not balanced in the flexible pouch 60, wherein the flexible pouch 60 is airtight and/or gradually vacuumed over dispensing usage.

Alternatively, a packaging system 1 for storing a fluid substance F is provided and comprises a pump dispenser 100. A pump dispenser 100 is provided and comprises a pump assembly 50, a flexible pouch 60 and a connecting shell 30; wherein the flexible pouch 60 contains a fluid substance F to be dispensed, wherein the flexible pouch 60 has a spout 61; wherein the spout 61 is a sleeve having inner and outer surfaces (611, 612); wherein the connecting shell 30 has a cavity therein, wherein the connecting shell 30 has an upper portion 310 and a lower portion 320; wherein the pump assembly 50 includes an actuator 10 having a cavity therein; and a closure 20 connected to the actuator 10; wherein the pump assembly 50 has an housing 51 having an outer surface 510 and a lower end 520; wherein the housing 51 of the pump assembly 50 is secured at the upper portion 310 of the connecting shell 30, wherein the cavity of the connecting shell 30 and the outer surface 510 of the housing 51 of the pump assembly 50 form an air chamber 330 or wherein the cavity of the housing 51' forms an air chamber 513'; wherein the housing 51 of the pump assembly 50 has a port 56 at the lower end 520 of the housing 51; wherein the lower portion 320 of the connecting shell 30 is removably engaged with the outer surface 612 of the spout 61 of the flexible pouch 60, and characterized in that the pump assembly 50 is removably engaged with the flexible pouch 60 in an airtight sealing manner; such that when the actuator 10 is pushed down and released by a user, air is not balanced in the flexible pouch 60, wherein the flexible pouch 60 is airtight and/or gradually vacuumed, over dispensing usage. In that aspect, air is not balanced in the air chamber (330, 513').

A method of dispensing a fluid substance F contained in a flexible pouch 60 of a pump dispenser 100 as disclosed herein is provided and comprises the following steps, preferably in that order:

a) providing a pump assembly 50, wherein the pump assembly 50 includes an actuator 10 and a closure 20 connected to the actuator 10;
b) optionally providing a sealing piece 40 and inserting the sealing piece 40 at a port 56 of a pump assembly 50;
c) providing a connecting shell 30 and engaging the connecting shell 30 to the closure 20 of the pump assembly 50;
d) providing the flexible pouch 60 comprising the fluid substance F;
e) securing the flexible pouch 60 to the pump assembly 50 and the connecting shell 30, wherein a lower portion 320 of the connecting shell 30 is removably engaged with an outer surface 612 of the spout 61 of the flexible pouch 60; and wherein the pump assembly 50 is removably engaged with the flexible pouch 60 in an airtight sealing manner;
f) triggering and releasing the actuator 10 of the pump assembly 50, such that air does not flow back to the flexible pouch 60, wherein the flexible pouch 60 is airtight and/or gradually vacuumed over dispensing usage, and the flexible pouch 60 shrinks when the fluid substance F is expelled out of the pump dispenser 100.

BRIEF DESCRIPTION OF THE DRAWINGS

While the specification concludes with claims particularly pointing out and distinctly claiming the present invention, it is believed that the same will be better understood from the following description read in conjunction with the accompanying drawings in which:

DETAILED DESCRIPTION OF THE INVENTION

Definitions of Terms

Figure 1:
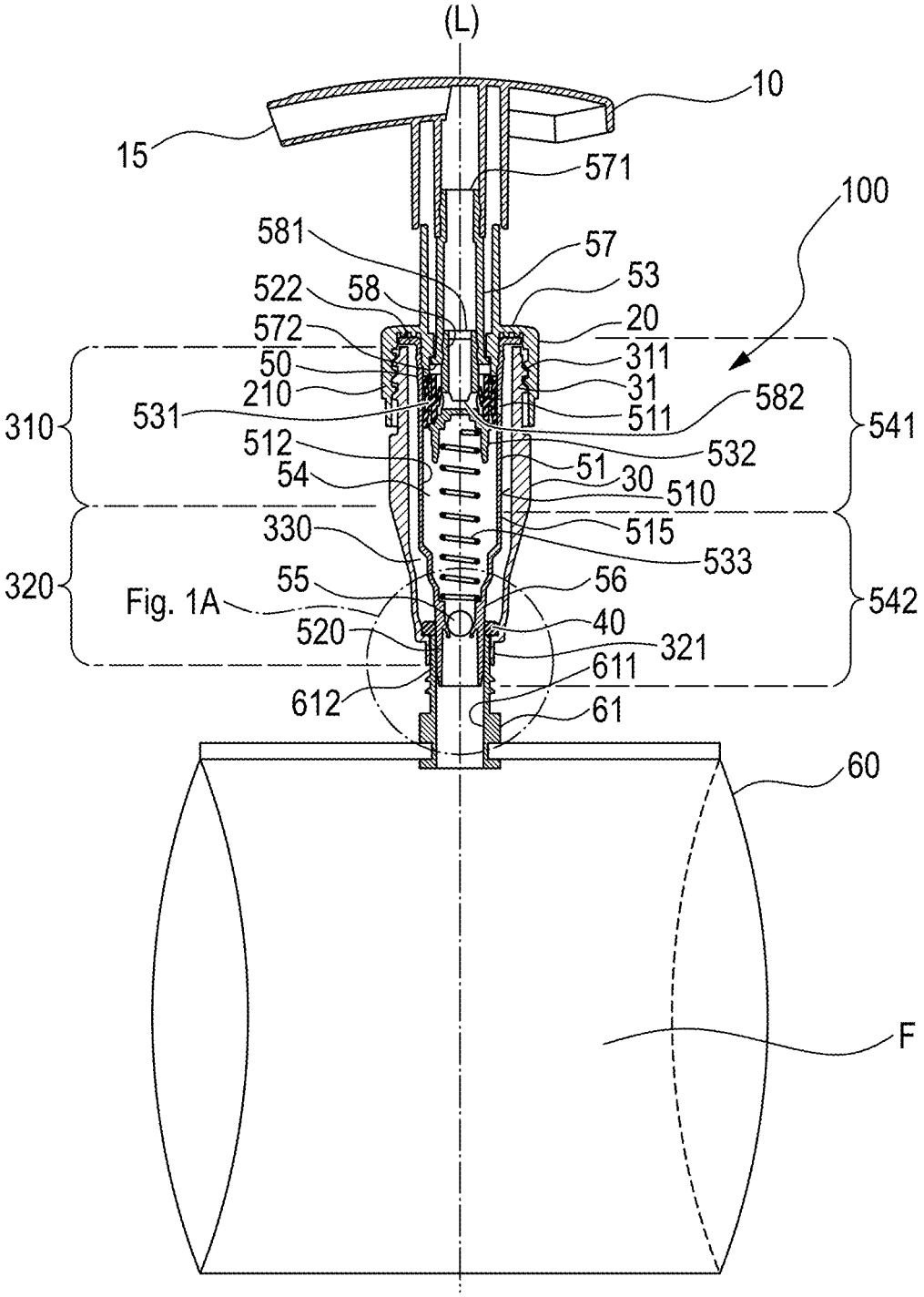
FIG. 1 provides a cross-sectional view of a pump dispenser as shown and described herein.

In this document, the following definitions apply unless specifically stated otherwise.

The terms "comprise", "comprising", and "comprises" as used herein are open ended terms, each specifying the presence of what follows, e.g., a component, but not precluding the presence of other features, e.g., elements, steps or components known in the art, or disclosed herein. "Comprising" encompasses the terms "consisting of" and "consisting essentially of". The pump dispensers, pump assemblies, methods, uses, and processes described herein can comprise, consist of, and consist essentially of the elements and limitations described herein, as well as any of the additional or optional ingredients, components, steps, or limitations described herein. Embodiments and aspects described herein may comprise or be combinable with elements, features or components of other embodiments and/or aspects despite not being expressly exemplified in combination, unless an incompatibility is stated.

As used herein, the articles including "a" and "an" when used in a claim, are understood to mean "one or more" of what is claimed or described.

The terms "include," "includes," and "including," as used herein are meant to be non-limiting.

The term "consumer product" as used herein means products intended to be used or consumed in the form in which it is sold. Such products include but are not limited to products for and/or uses relating to treating as a surface of interest, keratin fibers, hair, skin or fabrics. As used herein "consumer product" means baby care, beauty care, fabric & home care, family care, feminine care, health care, or devices intended to be used or consumed in the form in which it is sold, and not intended for subsequent commercial manufacture or modification. Such products include but are not limited to fine fragrances (e.g. perfumes, colognes, eau de toilettes, after-shave lotions, pre-shave, face waters, tonics, and other fragrance-containing compositions for application directly to the skin); products for and/or methods relating to treating human hair, including, bleaching, coloring, dyeing, conditioning, shampooing, styling; deodorants and antiperspirants; personal cleansing; cosmetics; skin care including application of creams, lotions, and other topically applied products for consumer use; and shaving products, products (e.g. lotions) for and/or methods relating to treating fabrics, hard surfaces and any other surfaces in the area of fabric and home care, including: air care, dishwashing, fabric conditioning (including softening), laundry detergency, laundry and rinse additive and/or care, hard surface cleaning and/or treatment, and other cleaning for consumer or institutional use; products and/or methods relating to oral care including toothpastes, tooth gels, tooth rinses, tooth whitening; over-the-counter health care including cough and cold remedies, and pain relievers.

The term "cleaning composition" as used herein includes, unless otherwise indicated, granular or powder-form all-purpose or "heavy-duty" washing agents, especially cleaning detergents; liquid, gel or paste-form all-purpose washing agents, especially the so-called heavy-duty liquid types; liquid fine-fabric detergents; hand dishwashing agents or light duty dishwashing agents, especially those of the high-foaming type; machine dishwashing agents, including the various pouches, tablet, granular, liquid and rinse-aid types for household and institutional use; liquid cleaning and disinfecting agents, including antibacterial hand-wash types, cleaning bars, mouthwashes, denture cleaners, dentifrice, car or carpet shampoos, bathroom cleaners; hair shampoos and hair-rinses; shower gels and foam baths and metal cleaners; as well as cleaning auxiliaries such as bleach additives and "stain-stick" or pre-treat types, substrate-laden products such as dryer added sheets, dry and wetted wipes and pads, nonwoven substrates, and sponges; as well as sprays and mists.

The term "fabric care composition" as used herein includes, unless otherwise indicated, fabric softening compositions, fabric enhancing compositions, fabric freshening compositions and combinations thereof. The form of such compositions includes liquids, gels, beads, powders, flakes, and granules.

The term "personal cleansing composition" as used herein refers to compositions intended for topical application to the hair and the skin for cleansing.

The term "mixtures" as used herein is meant to include a simple combination of materials and any compounds that may result from their combination.

The term "substance" as used herein refers to any ingredient, composition that needs to be kept separate from the formulation contained in the bottle. Suitable ingredients may be but not limited to sensitive ingredients, active ingredients, benefit agents or incompatible agents.

The term "surface of interest" as used herein refers to hair when the composition is a cleaning composition in the form of a hair shampoo, or a hair conditioner; alternatively to skin when the cleaning composition is in the form of a personal care product such as a shower or bath cream, a body wash or foaming body wash; alternatively to fabrics such as a liquid detergent or a fabric softener.

All percentages are by weight (w/w) of formulation or the fluid substance or the pump dispenser or the pump assembly, unless otherwise specified. "% wt." means percentage by weight. References to 'parts' e.g. a mixture of 1 part X and 3 parts Y, is a ratio by weight. All ratios or percentages are weight ratios or weight percentages unless specifically stated otherwise.

Where amount ranges are given, these are to be understood as being the total amount of said ingredient in the composition (substance, formulation, or fluid substance), the consumer product or the package component (pump dispenser, pump assembly), or where more than one species fall within the scope of the ingredient definition, the total amount of all ingredients fitting that definition, in the composition, the consumer product or the package component.

The amount of each particular ingredient or mixtures thereof described hereinafter can account for up to 100% (or 100%) of the total amount of the ingredient(s) in the fluid substance, or the composition, the consumer product or the package component.

The term "free of" as used herein means that a specific ingredient of a fluid substance, or a composition or a component of the pump dispenser or the pump assembly, e.g., the pump dispenser comprises 0% of an ingredient by total weight of specific component of the pump dispenser thus no detectable amount of the stated ingredient.

The term "substantially free of" as used herein means less than 1%, less than 0.8%, less than 0.5%, less than 0.3%, or less than an immaterial amount of a stated ingredient by total weight of the fluid substance, or the composition or the pump dispenser or the pump assembly.

The term "room temperature" refers to a temperature of 25 °C.

All measurements are understood to be made at 25 °C and at ambient conditions, where "ambient conditions" means at 1 atmosphere (atm) of pressure and at 65% relative humidity, unless otherwise stated. "Relative humidity" refers to the ratio (stated as a percent) of the moisture content of air compared to the saturated moisture level at the same temperature and pressure. Relative humidity can be measured with a hygrometer, in particular with a probe hygrometer from VWR® International.

Herein, the longitudinal axis of the pump dispenser with the pump assembly, the connecting shell and the flexible pouch, and the outer case are coaxial with the longitudinal axis of the packaging system. Any longitudinal axis herein is referenced with the letter "L".

Pump Dispenser

A packaging system 1 for storing a fluid substance F is provided and comprises a pump dispenser 100. The pump dispenser 100 comprises a pump assembly 50, a flexible pouch 60 and a connecting shell 30.

The pump dispenser 100 may comprise a longitudinal axis (L).

FIG. 1 provides a cross-sectional view of an example of a pump dispenser 100 as shown and described herein.

The flexible pouch 60 contains a fluid substance F to be dispensed. The flexible pouch 60 has a spout 61. The spout 61 is a sleeve having inner and outer surfaces (611, 612).

The connecting shell 30 has a cavity therein. The connecting shell 30 has an upper portion 310 and a lower portion 320. The connecting shell 30 has a lower end 321.

The connecting shell 30 of the pump dispenser 100 may have an open top and an open bottom. The connecting shell 30 of the pump dispenser 100 may have a side wall having an outer surface and an inner surface.

The connecting shell 30 may have a generally hollow cylindrical shape.

The pump assembly 50 includes an actuator 10 having a cavity therein; and a closure 20 connected to the actuator 10.

The connecting shell 30 may have a neck 31 having a neck landing zone at the upper portion 310 of the connecting shell 30. The neck 31 of the connecting shell 30 may preferably have outer threads 311.

More specifically, the closure 20 of the pump assembly 50 may be coupled to the neck 31 of the connecting shell 30. The closure 20 of the pump assembly 50 may be threadingly engaged with the neck 31 of the connecting shell 30. The closure 20 may have inner threads 210. The inner threads 210 of the closure 20 may engage with the outer threads 311 of the neck 31 of the connecting shell 30 to secure the pump assembly 50 to the connecting shell 30.

The fluid substance F discharged from the pump dispenser 100 is typically discharged through an actuator outlet 15 of the actuator 10.

Optionally, the pump dispenser 100 may further comprise a clip to lock the actuator 10 before a first use, wherein the clip is positioned between the actuator 10 and the closure 20.

Alternatively and optionally, the actuator 10 may be typically auto-locked. In that aspect, the actuator 10 may be typically unlocked by rotating the actuator at 90 degrees.

The pump assembly 50 of the pump dispenser 100 has an housing 51 having an outer surface 510 and an inner surface 512. The housing 51 has a lower end 520 and an upper end 522.

The housing 51 of the pump assembly 50 may have an open top and an open bottom. The open top of the housing 51 is located at the upper end 522 of the housing 51. The open bottom of the housing 51 is located at the lower end 520 of the housing 51. The housing 51 of the pump assembly 50 has a side wall 515 having the outer surface 510 and the inner surface 512.

The housing 51 of the pump assembly 50 may have a cylindrical shape.

The various parts of the housing 51 and the connecting shell 30 are not limited to a cylindrical tube per se. The housing 51 and/or the connecting shell 30 may have any suitable outer shape, including, e.g., a generally cylindrical shape, a generally conical shape, a generally elliptical shape, or any combination thereof. As used herein, the terms "generally cylindrical", "generally conical" and "generally elliptical" describe shapes strictly cylindrical, conical and elliptical and those deviating from strictly cylindrical, conical and elliptical shapes. Examples of such "generally cylindrical" and "generally conical" or "generally elliptical" may include, without limitation, the housing 51 and/or the connecting shell 30 having a cross-sectional shape deviating from circular by being elongated in a direction transverse to the longitudinal axis, e.g., elliptical, oval, and the like. Other suitable shapes might be encompassed but less preferred, e.g., polygonal, rectangular prism, cuboid, and so on or a combination of generally cylindrical/conical and polygonal shapes.

The housing 51 of the pump assembly 50 may comprise a double cylinder that are formed integrally and that are concentrically to each other. The housing 51 of the pump assembly 50 may include an upper and lower cylinders, wherein the upper cylinder has a diameter greater that a diameter of the lower cylinder. The lower cylinder of the housing 51 may provide a funnel-shaped valve seat portion for receiving an inlet one-way valve 55.

The housing 51 of the pump assembly 50 is secured at the upper portion 310 of the connecting shell 30. Namely, the upper end 522 of the housing 51 of the pump assembly 50 is positioned between the neck 31 of the connecting shell 30 and the closure 20 of the pump assembly 100. As such, the housing 51 of the pump assembly 50 may be interior to the connecting shell 30 of the pump dispenser 100.

In an aspect, the cavity of the connecting shell 30 and the outer surface 510 of the housing 51 of the pump assembly 50 form an air chamber 330. The housing 51 of the pump assembly 50 includes an air ventilating hole 511, preferably located an upper portion of the housing 51. The air ventilating hole 511 of the housing 51 of the pump assembly 50 can help to balance air in the cavity of the connecting shell 30 when the fluid substance F is dispensed from the pump dispenser 100.

When the actuator 10 is pressed down and released, air can enter between the actuator 10 and the closure 20 to the cavity of the housing 51 towards the air chamber 330 through the air ventilating hole 511.

The housing 51 of the pump assembly 50 has a port 56 at the lower end 520 of the housing 51.

The connecting shell 30, the pump assembly 50 and the flexible spout 60 of the pump dispenser 100 are connecting as follows:

The lower portion 320 of the connecting shell 30 is removably engaged with the outer surface 612 of the spout 61 of the flexible pouch 60. The pump assembly 50 is removably engaged with the flexible pouch 60 in an airtight sealing manner such that when the actuator 10 is pushed down and released by a user, air is balanced in the air chamber 330 by the air ventilating hole 511 and air is not balanced in the flexible pouch 60. The flexible pouch 60 is airtight and/or gradually vacuumed, over dispensing usage.

Specifically, the port 56 of the pump assembly 50 may be removably engaged with the inner surface 611 of the spout 61 of the flexible pouch 60 in an airtight sealing manner such that when the actuator 10 is pushed down and released by a user, air is balanced in the air chamber 330 by the air ventilating hole 511 and air is not balanced in the flexible pouch 60. The flexible pouch 60 is gradually vacuumed over dispensing usage.

Figure 1A:
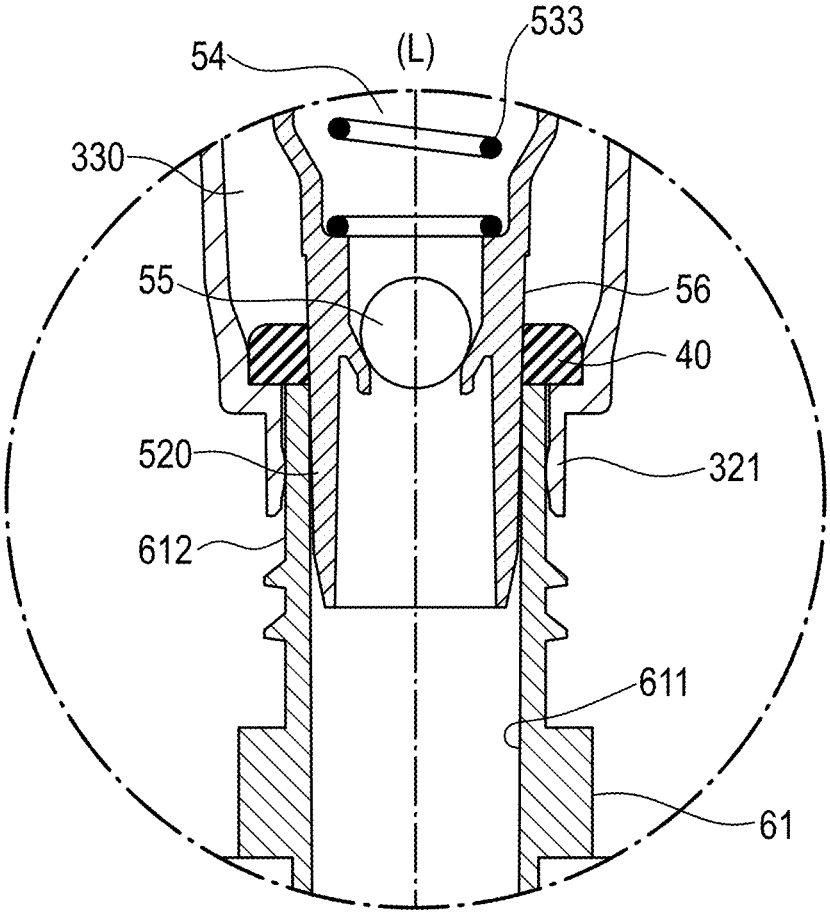
FIG. 1A provides an enlarged view of an area of FIG. 1 including a cross-sectional view of a spout of a flexible pouch in engagement with a port of a pump assembly; and with a lower end of a connecting shell in an airtight manner.

FIG. 1A provides an enlarged view of an area of FIG. 1 including a cross-sectional view of a spout 61 of a flexible pouch 60 in engagement with a port 56 of a pump assembly 50; and with a lower end 321 of a connecting shell 30 in an airtight manner.

In a first aspect, the lower portion 320 of the connecting shell 30 is removably engaged with the outer surface 612 of the spout 61 of the flexible pouch 60. The connecting shell 30 has the lower end 321 at the lower portion 320 of the connecting shell 30. In the first aspect, the lower end 321 of the connecting shell 30 may be removably engaged with the outer surface 612 of the spout 61 of the flexible pouch 60. Namely, the lower end 321 of the connecting shell 30 may be in interference with the outer surface 612 of the spout 61 of the flexible pouch 60.

In the first aspect, the port 56 of the pump assembly 50 is removably engaged with the inner surface 611 of the spout 61 of the flexible pouch 60 in an airtight sealing manner. As said above, the housing 51 of the pump assembly 50 has the port 56 at the lower end 520 of the housing 51. In the first aspect, the port 56 of the pump assembly 50 may be in interference with the inner surface 611 of the spout 61 of the flexible pouch 60 in an airtight sealing manner.

The connecting shell 30 of the pump dispenser 100 may comprise a sealing piece 40 positioned at a location where the port 56 of the pump assembly 50 is removably engaged with the spout 61 of the flexible pouch 60 such that the spout 61 and the pump assembly 50 are engaged in the airtight sealing manner.

Specifically, the sealing piece 40 may be positioned at a location where the port 56 of the pump assembly 50 is removably engaged with the spout 61 of the flexible pouch 60 such that the spout 61 and the port 56 of the pump assembly 50 are engaged in the airtight sealing manner.

As shown in a FIG. 1A, the sealing piece 40 may be positioned around the port 56 of the pump assembly 50 at the spout 61 of the flexible pouch 60 for providing an airtight scaling between the spout 61 of the flexible pouch 60 and the pump assembly 50, specifically for providing an airtight sealing between the spout 61 of the flexible pouch 60 and the port 56 of the pump assembly 50.

Hence, when the actuator 10 is released after pressing it, the sealing piece 40 ensures that air only flows from the air ventilating hole 511 of the housing 51 of the pump assembly 50 to the air chamber 330 and not back to the flexible pouch 60. The airtight sealing function, namely by the sealing piece 40, can enable the pump assembly 50 to gradually vacuum the flexible pouch 60. Hence, the flexible pouch 60 can be airtight and/or gradually vacuumed over dispensing usage by using the sealing piece 40 as an airtight means.

It is also worth noting that the sealing piece 40 can provide an additional airtightness means between the lower end 321 of the connecting shell 30 in interference with the outer surface 612 of the spout 61 of the flexible pouch 60. The sealing piece 40 can further prevent any air contamination that could pass between the lowed end 321 of the connecting shell 30 and the spout 61 of the flexible pouch 60; although the interference between the lower end 321 of the connecting shell 30 with the outer surface 612 of the spout 61 is already enough to prevent any air contamination.

In a second aspect, the lower portion 320 of the connecting shell 30 is removably engaged with the outer surface 612 of the spout 61 of the flexible pouch 60. The connecting shell 30 has the lower end 321 at the lower portion 320 of the connecting shell 30. In the second aspect, the lower end 321 of the connecting shell 30 may be removably engaged with the outer surface 612 of the spout 61 of the flexible pouch 60.

Figure 2:
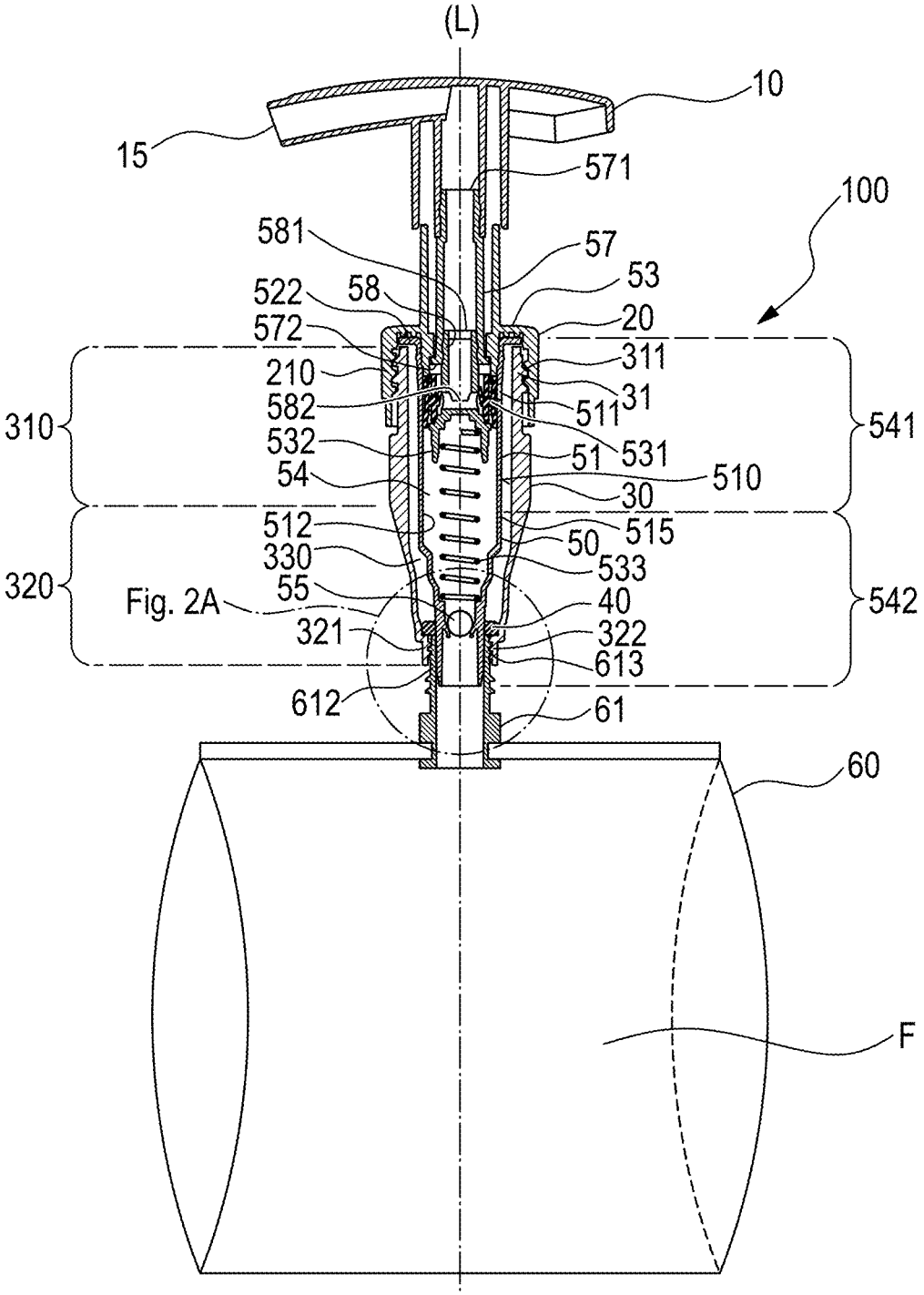
FIG. 2 provides a cross-sectional view of another pump dispenser as shown and described herein.

FIG. 2 provides a cross-sectional view of another example of a pump dispenser 100 as shown and described herein.

Figure 2A:
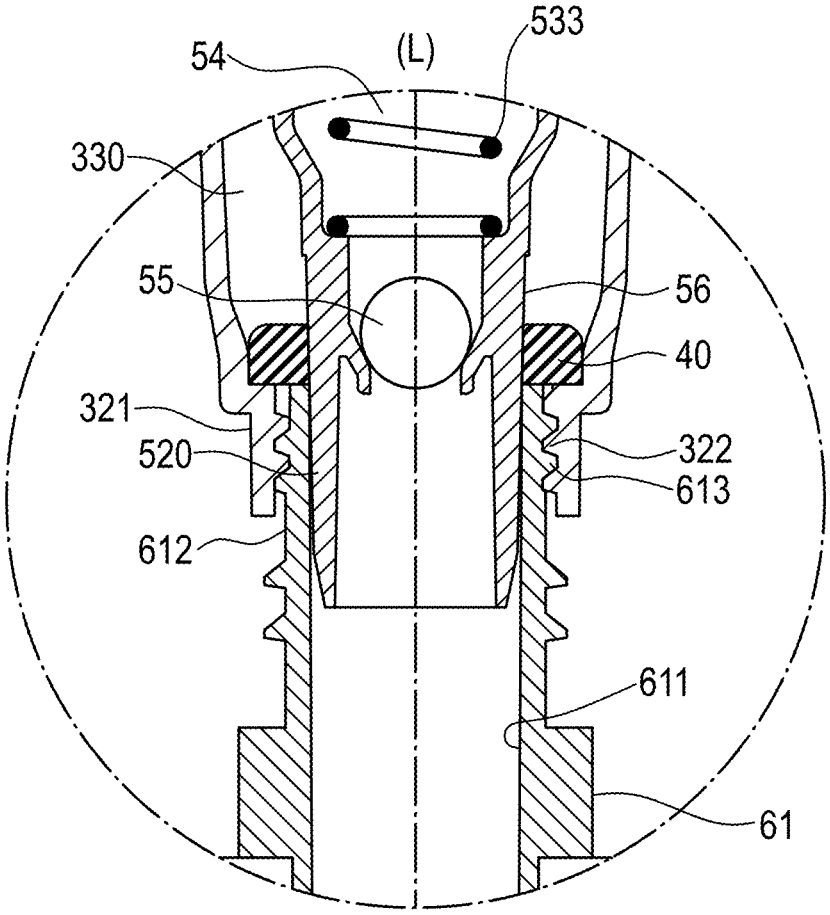
FIG. 2A provides an enlarged view of an area of FIG. 2 including a cross-sectional view of a spout of a flexible pouch in engagement with a lower end of a connecting shell, and with a port of a pump assembly in an airtight manner.

FIG. 2A provides an enlarged view of an area of FIG. 2 including a cross-sectional view of a spout 61 of a flexible pouch 60 in engagement with a port 56 of a pump assembly 50; and with a lower end 321 of a connecting shell 30 in an airtight manner.

For the second aspect, the lower end 321 of the connecting shell 30 may comprise inner threads 322. The spout 61 of the flexible pouch 60 may comprise outer threads 613 on the outer surface 612. The inner threads 322 of the lower end 321 of the connecting shell 30 may engage with the outer threads 613 of the spout 61 of the flexible pouch 60 to removably secure the connecting shell 30 to the flexible pouch 60.

In the second aspect, similarly as in the above first aspect, the port 56 of the pump assembly 50 is also removably engaged with the inner surface 611 of the spout 61 of the flexible pouch 60 in an airtight sealing manner. The port 56 of the pump assembly 50 may be in interference with the inner surface 611 of the spout 61 of the flexible pouch 60 in an airtight scaling manner.

The connecting shell 30 of the pump dispenser 100 may also comprise a sealing piece 40 positioned at a location where the port 56 of the pump assembly 50 is removably engaged with the spout 61 of the flexible pouch 60 such that the spout 61 and the pump assembly 50 are engaged in the airtight scaling manner.

Specifically, the sealing piece 40 may be positioned at a location where the port 56 of the pump assembly 50 is removably engaged with the spout 61 of the flexible pouch 60 such that the spout 61 and the port 56 of the pump assembly 50 are engaged in the airtight sealing manner.

As shown in a FIG. 2A, the sealing piece 40 may be positioned around the port 56 of the pump assembly 50 at the spout 61 of the flexible pouch 60 for providing an airtight sealing between the spout 61 of the flexible pouch 60 and the pump assembly 50, specifically for providing an airtight sealing between the spout 61 of the flexible pouch 60 and the port 56 of the pump assembly 50.

Hence, for the second aspect, when the actuator 10 is released after pressing it, the sealing piece 40 still prevent any air flowing back to the flexible pouch 60 but only allows air flowing from the air ventilating hole 511 of the housing 51 of the pump assembly 50 to the air chamber 330. The airtight sealing function, namely by the sealing piece 40, can enable the pump assembly 50 to gradually vacuum the flexible pouch 60. Hence, the flexible pouch 60 can be airtight and/or gradually vacuumed over dispensing usage by using the sealing piece 40 as an airtight means.

Again, it is also worth noting that the sealing piece 40 also can provide an additional airtightness means between the lower end 321 of the connecting shell 30 having inner threads 322 coupling to mating outer threads 613 of the outer surface 612 of the spout 61 of the flexible pouch 60. The sealing piece 40 can further prevent any air contamination that could pass between the lowed end 321 of the connecting shell 30 and the spout 61 of the flexible pouch 60; although the coupling of the inner threads 322 of the lower end 321 of the connecting shell 30 engaging with the outer threads 613 of the spout 61 is already enough to prevent any air contamination.

In a third aspect, the lower end 321 of the connecting shell 30 may be removably engaged with the outer surface 612 of the spout 61 of the flexible pouch 60. Namely, the lower end 321 of the connecting shell 30 may be in interference with the outer surface 612 of the spout 61 of the flexible pouch 60.

Figure 3:
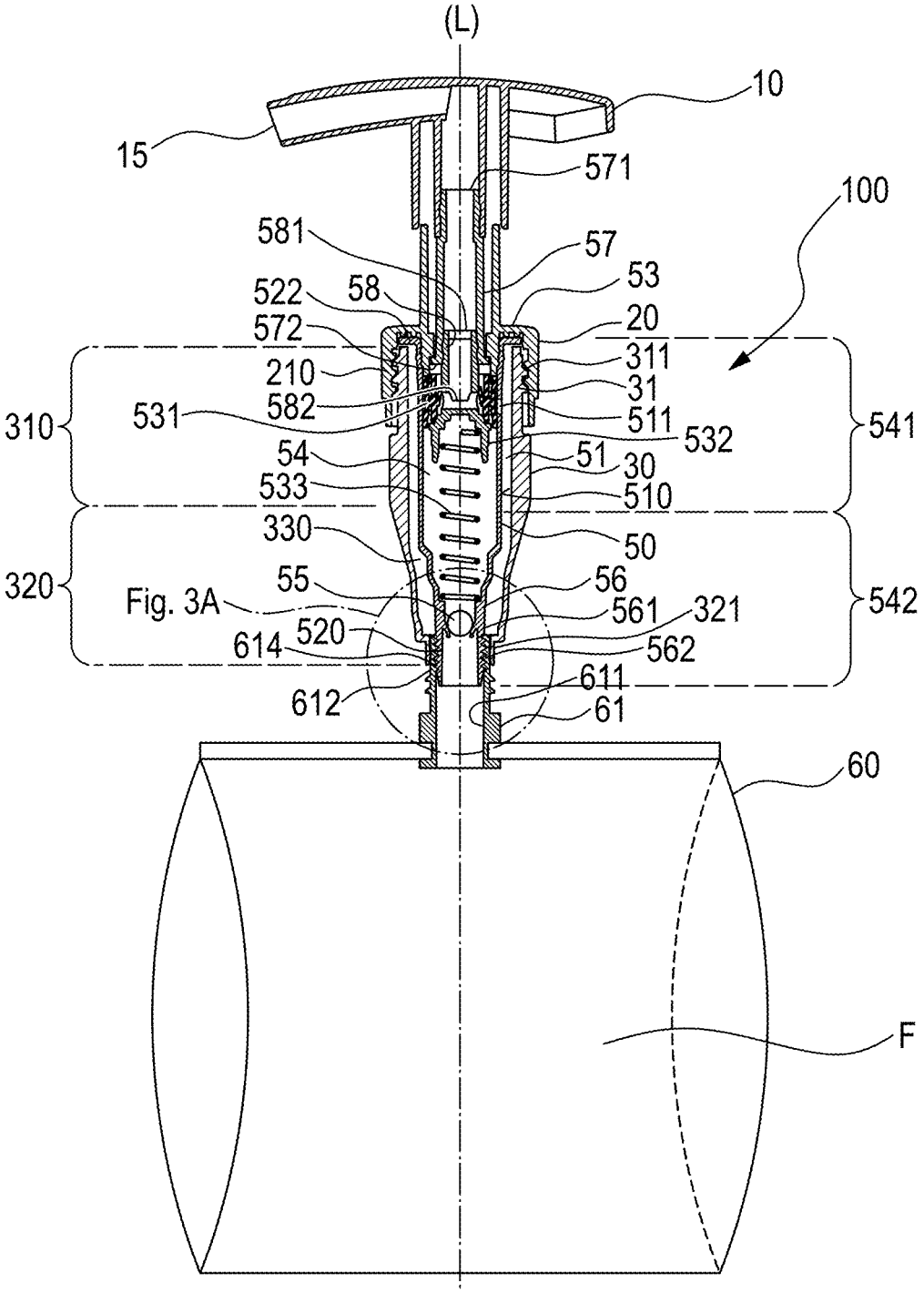
FIG. 3 provides a cross-sectional view of another pump dispenser as shown and described herein.

FIG. 3 provides a cross-sectional view of another pump dispenser 100 as shown and described herein.

In the third aspect, the port 56 of the pump assembly 50 is also removably engaged with the inner surface 611 of the spout 61 of the flexible pouch 60 in an airtight sealing manner. Unlike the above first and second aspects, the sealing piece 40 is not necessary.

Figure 3A:
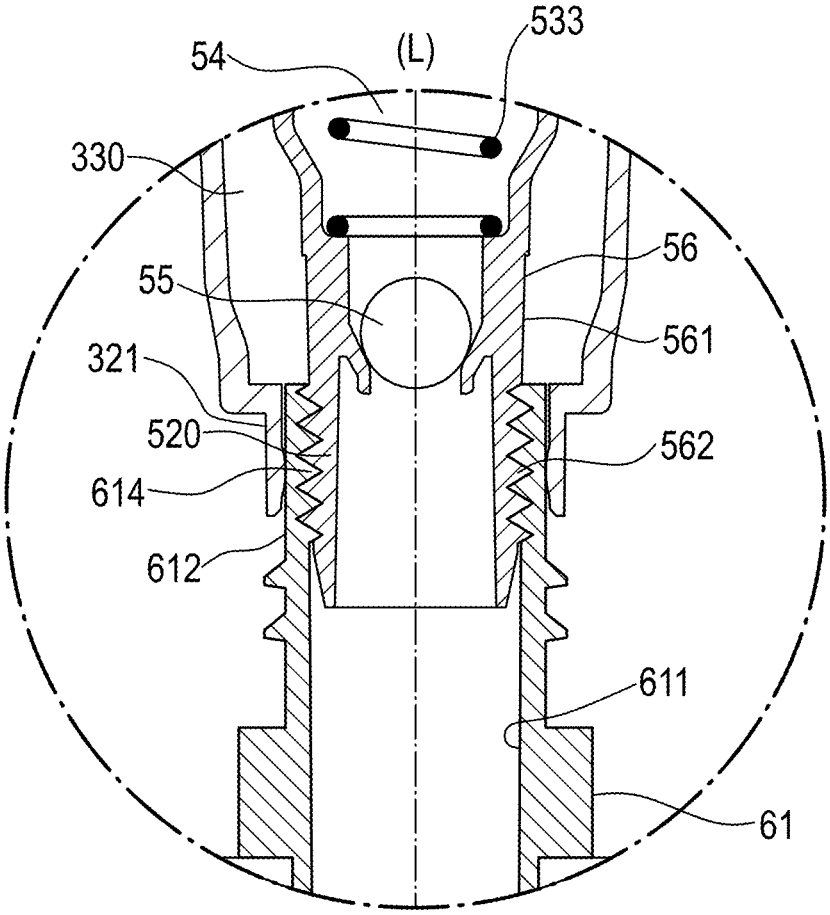
FIG. 3A provides an enlarged view of an area of FIG. 3 a cross-sectional view of a spout of a flexible pouch in engagement with a port of a pump assembly; with a lower end of a connecting shell in an airtight manner.

FIG. 3A provides an enlarged view of an area of FIG. 3 a cross-sectional view of a spout 61 of a flexible pouch 60 in engagement with a port 56 of a pump assembly 50; with a lower end 321 of a connecting shell 30 in an airtight manner.

The port 56 of the pump assembly 50 may comprise an outer surface 561. The port 56 of the pump assembly 50 may comprise outer threads 562 on the outer surface 561. The spout 61 of the flexible pouch 60 may comprise inner threads 614 on the inner surface 611. The outer threads 562 of the port 56 of the pump assembly 50 may engage with the inner threads 614 of the spout 61 of the flexible pouch 60 to removably secure the pump assembly 50 to the flexible pouch 60 in the airtight sealing manner.

Hence, when the actuator 10 is released after pressing it, the coupling of the outer threads 562 of the port 56 of the pump assembly 50 with the mating inner threads 614 of the spout 61 of the flexible pouch 60 ensures that air can only flow from the air ventilating hole 511 of the housing 51 of the pump assembly 50 to the air chamber 330 and not back to the flexible pouch 60.

Hence, the flexible pouch 60 can also be airtight and/or gradually vacuumed over dispensing usage without using a sealing piece 40 as an airtight means.

In the third aspect, as a further option, the connecting shell 30 of the pump dispenser 100 may additionally comprise a sealing piece 40 positioned at a location where the port 56 of the pump assembly 50 is removably engaged with the spout 61 of the flexible pouch 60 such that the spout 61 and the pump assembly 50 are engaged in the airtight sealing manner.

Specifically, the scaling piece 40 may be positioned at a location where the port 56 of the pump assembly 50 is removably engaged with the spout 61 of the flexible pouch 60 such that the spout 61 and the port 56 of the pump assembly 50 are engaged in the airtight sealing manner.

The sealing piece 40 may be positioned around the port 56 of the pump assembly 50 at the spout 61 of the flexible pouch 60 for providing a further airtight sealing between the spout 61 of the flexible pouch 60 and the pump assembly 50, specifically for providing a further airtight sealing between the spout 61 of the flexible pouch 60 and the port 56 of the pump assembly 50.

The sealing piece 40 can further provide an additional airtightness means between the lower end 321 of the connecting shell 30 in interference with the outer surface 612 of the spout 61 of the flexible pouch 60 as explained hereinabove for FIG. 1A.

Alternatively, the housing 51 of the pump assembly 50 may not include any air ventilating hole. In that case, when the actuator 10 is pushed down and released by a user, air is not balanced in the flexible pouch 60. Air is not balanced in the air chamber 330. Air can enter between the actuator 10 and the closure 20 towards the cavity of the housing 51 only. The flexible pouch 60 is airtight and/or gradually vacuumed, over dispensing usage.

In all the above aspects, the pump dispenser 100 may not include any dip tube. Preferably, the pump dispenser 100 may not include any dip tube wherein the flexible pouch 60 comprises a relatively low viscous fluid substance F, preferably wherein the fluid substance (F) has a viscosity from 1 mPa·s (1 cps) to 5 Pa·s (5000 cps) or from 1 mPa·s (1 cps) to 1 Pa·s (1000 cps) as measured on a 2.5 mL sample using a one and plate Brookfield RS rheometer with cone C75-1 at constant shear rate of 2 $s^{-1}$ at 27 °C at 3 mins.

The packaging system 1 does not require any dip tube for dispensing any relatively low viscous fluid substance F from the flexible pouch 60. The vacuum generated during dispensing usage is enough to remove any product residues that may reside within the flexible pouch 60 at the end of the dispensing usage.

Also, by not using any dip tube, any product contamination that might come from a dip tube can be avoided when changing the flexible pouch 60 by a new one.

Typically, the pump assembly 50 may be selected from the group consisting of a liquid pump assembly, and a foaming pump assembly.

Liquid Pump Assembly

The pump assembly 50 may be a liquid pump assembly. The liquid pump assembly may comprise a piston assembly 53 and a pump chamber 54. The piston assembly 53 may be in fluid communication with the actuator 10.

The piston assembly 53 may comprise a piston skirt 531; a piston sub-stem 532 engaged with the piston skirt 531, namely attached to the piston skirt 531; and a spring 533.

The cavity of the housing 51 of the pump assembly 50 may forms the pump chamber 54. The pump chamber 54 has a cavity therein, wherein the pump chamber 54 has an upper and a lower portion (541, 542), wherein the piston assembly 53 is interior to the pump chamber 54 and slidable engaged with the pump chamber 54.

In that aspect, the piston skirt 531 can seal the upper portion 541 of the pump chamber 54.

The piston assembly 53 and the housing 51 of the pump assembly 50 may be moveable relative to each other. The piston assembly 53 may be moveable within a stationary housing 51, which is a practical approach.

The actuator 10 may be engaged with the piston assembly 53 or the housing 51 of the pump assembly 50, depending of the mechanism for providing movement of the piston assembly 53 and housing 51 relative to one another. The actuator 10 may be pressed to actuate movement of the piston assembly 53 and housing 51 relative to one another. In a reasonably practical arrangement, the actuator 10 may be engaged with the piston assembly 53 to drive movement of the piston assembly 53 within a stationary housing 51. That is the piston assembly 53 may move relative to a stationary housing 51.

The liquid pump assembly may further comprise a stem 57 having an upper end 571 and a lower end 572, wherein the actuator 10 is adapted to receive the upper end 571 of the stem 57, wherein the upper end 571 of the stem 57 is rigidly connected to the actuator 10, wherein the stem 57 is in fluid communication with the actuator 10.

The lower end 572 of the stem 57 is rigidly connected to the closure 20 and in engagement with a sub-stem 58.

The sub-stem 58 may have an upper end 581 and a lower end 582, wherein lower end 572 of the stem 57 is adapted to receive the upper end 581 of the sub-stem 58, wherein both the stem 57 and sub-stem 58 are in fluid communication with the actuator 10. The lower end 582 of the sub-stem 58 may rigidly connected to the piston skirt 531.

In that aspect, the piston assembly 53 may be in fluid communication with the stem 57, wherein the piston skirt 531 holds the sub-stem 58 that is connected to the stem 57.

The spring 533 of the piston assembly 53 may be positioned between the piston sub-stem 532, or adjacent and spaced to the piston skirt 531 to an inlet one-way valve 55 at the lower portion 542 of the pump chamber 54 or adjacent and spaced to the lower portion 542 of the pump chamber 54.

Hence, when the actuator 10 is pushed down by a user, the piston assembly 53 moves to push down the piston sub-stem 532 and compress the spring 533 towards the inlet one-way valve 55.

FIGS. 1-3 provides cross-sectional views of a liquid pump assembly, wherein a spring 533 is located within a hollow inner cavity of the housing 51 between the piston sub-stem 532 and the inlet one-way valve 55.

In all aspects, the spring 533 may comprise a design selected from the group consisting of single helix, double helix, stacked double helix, wave spring, and combinations thereof.

The inlet one-way valve 55 permits flow of the fluid substance F in the upstream direction from the flexible pouch 60 to the actuator 10 and prevents flow of the fluid substance F in the downstream direction.

Inlet One-Way Valve

The liquid pump assembly may include an inlet one-way valve 55 such that the inlet one-way valve 55 permits fluid flow in a upstream direction from the flexible pouch 60 towards the pump chamber 54 and the actuator 10 to prevent fluid flow in a downstream direction.

The inlet one-way valve 55 may be typically selected from the group consisting of a free-floating ball check valve, a spring-loaded ball check valve, a diaphragm check valve, a swing check valve, a flapper valve, a clapper valve, a backwater valve, a lift check valve, an in-line check valve, an umbrella valve, and a duckbill valve.

Foaming Pump Assembly

Alternatively, the pump assembly 50 may be a foaming pump assembly.

Figure 4:
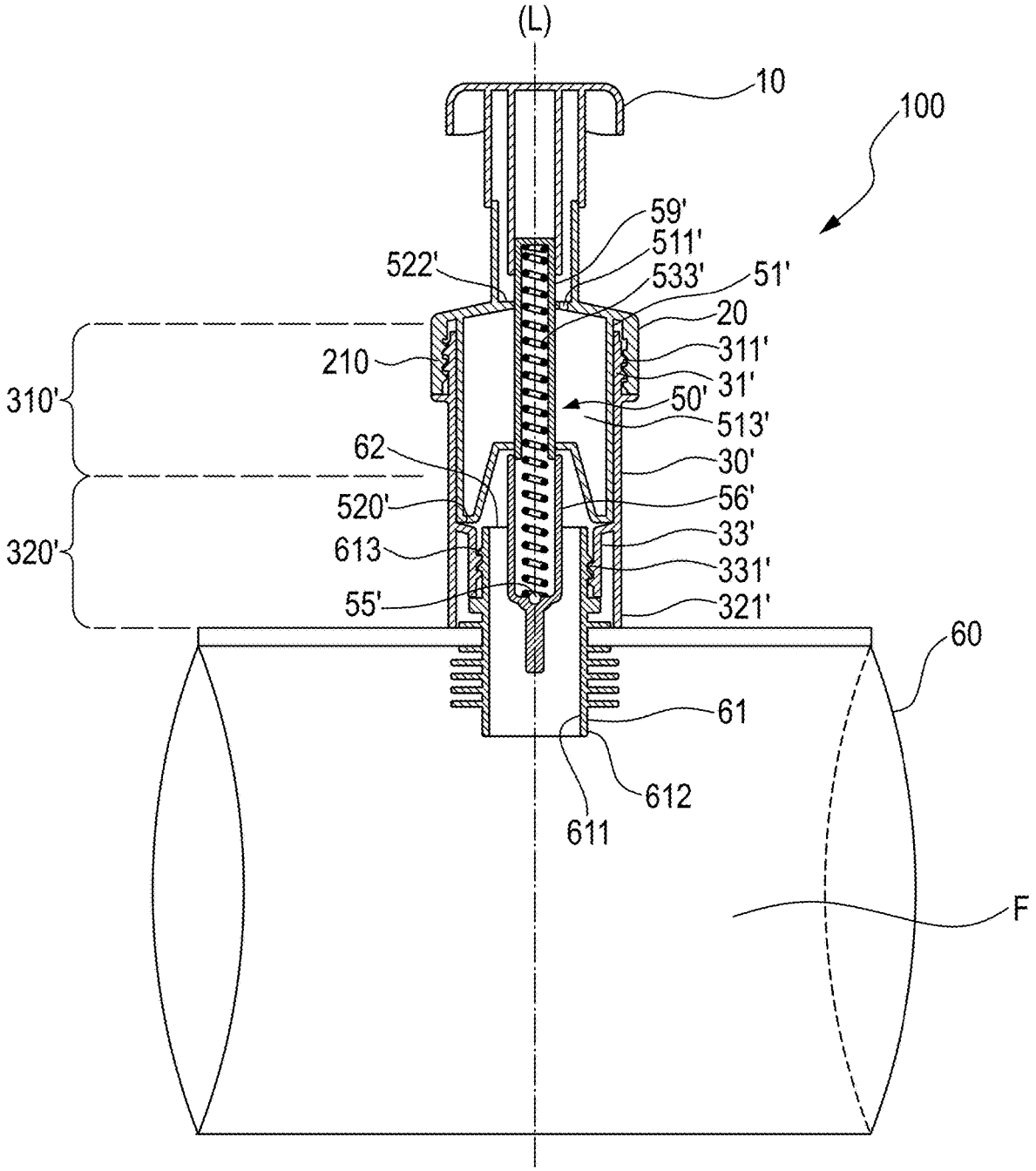
FIG. 4 provides a cross-sectional view of another pump dispenser as shown and described herein.

FIG. 4 provides a cross-sectional view of another pump dispenser as shown and described herein with an example of a foaming pump assembly 50'.

The pump dispenser 100 comprises a foaming pump assembly 50', a flexible pouch 60 and a connecting shell 30'.

The flexible pouch 60 contains a fluid substance F to be dispensed. The flexible pouch 60 has a spout 61. The spout 61 is a sleeve having inner and outer surfaces (611, 612).

The connecting shell 30' has a cavity therein. The connecting shell 30' has an upper portion 310' and a lower portion 320'. The connecting shell 30' has a lower end 321'.

The connecting shell 30' of the pump dispenser 100 may have an open top and an open bottom. The connecting shell 30' of the pump dispenser 100 may have a side wall having an outer surface and an inner surface.

The connecting shell 30' may have a sleeve 33' having a cavity therein and protruding from the side wall of the connecting shell 30', at the lower portion 320' of the connecting shell 30', wherein the sleeve 33' may have inner threads 331'.

The connecting shell 30' may have a generally hollow cylindrical shape.

The connecting shell 30' may be a double cylinder formed integrally having an upper cylinder to receive the foaming pump assembly 50' and a lower cylinder, wherein the lower cylinder forms the sleeve 33' of the connecting shell 30'. The upper and lower cylinders of the connecting shell 30' are formed concentrically with each other.

The foaming pump assembly 50' includes an actuator 10 having a cavity therein; and a closure 20 connected to the actuator 10.

The connecting shell 30' may have a neck 31' having a neck landing zone at the upper portion 310' of the connecting shell 30'. The neck 31' of the connecting shell 30' may preferably have outer threads 311'.

More specifically, the closure 20 of the foaming pump assembly 50' may be coupled to the neck 31' of the connecting shell 30'. The closure 20 of the foaming pump assembly 50' may be threadingly engaged with the neck 31' of the connecting shell 30'. The closure 20 may have inner threads 210. The inner threads 210 of the closure 20 may engage with the outer threads 311' of the neck 31' of the connecting shell 30' to secure the foaming pump assembly 50' to the connecting shell 30'.

The foaming pump assembly 50' of the pump dispenser 100 has an housing 51' having an outer surface and an inner surface. The housing 51' has a lower end 520' and an upper end 522'. The housing 51' has a cavity therein.

The housing 51' of the foaming pump assembly 50' may have an open top and an open bottom. The open top of the housing 51' is located at the upper end of the housing 51'. The open bottom of the housing 51' is located at the lower end of the housing 51'. The housing 51' of the foaming pump assembly 50' has a side wall having the outer surface and the inner surface.

The upper end of the housing 51' may be co-extruded with the closure 20 to form one single piece. Thus, the housing 51' and the closure 20 may be integrally formed. The housing 51' of the foaming pump assembly 50' may be interior to the connecting shell 30' of the pump dispenser 100.

In the alternate aspect, the housing 51' forms an air chamber 513'. The housing 51' of the pump assembly 50' includes an air ventilating hole 511', preferably at an upper portion of the housing 51'. Specifically, the housing 51' of the pump assembly 50' may include an air ventilating hole 511' located at or adjacent of the upper end of the housing 51' in the closure 20.

The foaming pump assembly 50' may include a liquid piston 59'. The liquid piston 59' may have a generally hollow cylindrical shape. The liquid piston 59' may have a closed upper end and an open lower end, wherein the closed upper end receives a spring 533'. The spring 533' may have a design as described hereinbefore. The liquid piston 59' may be press-fitter in a rod portion of the actuator 10 and through the housing 51'. Thus, the actuator 10 and the liquid piston 59' can move up and down integrally.

As the housing 51' and the closure 20 may be integrally formed, the air ventilating hole 511' may be located at the closure 20; and at or at proximity of the liquid piston 59' at the upper portion 310' of the connecting shell 30.

The air ventilating hole 511' of the housing 51' of the foaming pump assembly 50' can help to balance air in the air chamber 513' when the fluid substance F is dispensed from the pump dispenser 100.

Alternatively, the housing 51' may include no air ventilating hole 511'. As the pouch 60 is flexible, the flexible pouch 60 can still be vacuumed gradually over dispensing usage.

The housing 51' of the foaming pump assembly 50' has a port 56' at the lower end 520' of the housing 51'. The port 56' may have a generally hollow cylindrical shape and include an annular seat portion converging downwardly at a lower end of the port 56'.

The lower cylinder of the housing 51' may provide the annular seat portion as a funnel-shaped valve seat portion for receiving an inlet one-way valve 55' as described hereinbefore.

The port 56' may have an open upper end having a diameter greater that a diameter of the open lower end of the liquid piston 59' such that the upper end of the port 56' closes the lower end of the liquid piston 59'. Hence, the spring 533' is positioned between the closed upper end of the liquid piston 59' and the annular seat portion of the port 56'.

The connecting shell 30', the foaming pump assembly 50' and the flexible spout 60 of the pump dispenser 100 may be connecting as follows:

The lower portion 320' of the connecting shell 30' may be removably engaged with the outer surface 612 of the spout 61 of the flexible pouch 60.

The spout 61 of the flexible pouch 60 may comprise outer threads 613 on the outer surface 612. The inner threads 331' of the sleeve 33' of the connecting shell 30' at the lower portion 320' may engage with the outer threads 613 of the spout 61 of the flexible pouch 60 to removably secure the connecting shell 30' to the flexible pouch 60 in the airtight sealing manner.

The foaming pump assembly 50' is removably engaged with the flexible pouch 60 in the airtight sealing manner. This is due to the fact that the inner threads 331' of the sleeve 33' of the connecting shell 30' at the lower portion 320' engage with the outer threads 613 of the spout 61 of the flexible pouch 60. When the actuator 10 is pushed down and released by a user, air is only balanced in the air chamber 513' by the air ventilating hole 511' of the housing 51' and air is not balanced in the flexible pouch 60.

When the actuator 10 is pressed down and released, air can enter between the actuator 10 and the closure 20 to the cavity of the housing 51 forming the air chamber 513' through the air ventilating hole 511' located at or adjacent of the upper end of the housing 51' in the closure 20. Air can only flow to the air chamber 513' of the housing 51' and not to the flexible pouch 60.

Hence, the flexible pouch 60 is airtight and/or gradually vacuumed over dispensing usage.

Flexible Pouch

The spout 61 of the flexible pouch 60 may be an outlet through which contents of the fluid substance F are taken out from the flexible pouch 60.

The spout 61 of the flexible pouch 60 may have a lid 62. The port 56 of the pump assembly 50 may rupture the lid 62 of the flexible pouch 60 when the port 56 of the pump assembly 50 engages for the first time of use with the spout 61 of the flexible pouch 60.

Alternatively, the spout 61 of the flexible pouch 60 may have a cap. The cap may be screwed on or snapped on the spout 61 to seal the pouch in airtight manner. Before use, the cap needs to be removed for opening the flexible pouch 60.

The flexible pouch 60 may be made of a transparent or semi-transparent material.

The flexible pouch 60 may be made from a film having a sufficient thickness to allow the flexible pouch to stand up by itself. The film of the flexible pouch 60 may have a front and back walls and a gusset portion of the left and right side walls, and a bottom portion as a base where the flexible pouch can reside.

The flexible pouch 60 may be an elastic pouch or a soft pouch that may or may not have a fixed appearance.

The flexible pouch 60 may have a restoring force to return to its original shape when it expands or expands due to elasticity while changing its shape by an external force.

For this aspect, the flexible pouch 60 may be exemplarily formed of an elastic material, or may be formed of an extensible material, exemplarily, may be formed of silicone, natural or synthetic latex rubber, or a polymer material.

Packaging System

The packaging system 1 may further comprise an outer case 110 for storing the pump dispenser 100 and the flexible pouch 60.

Figure 5:
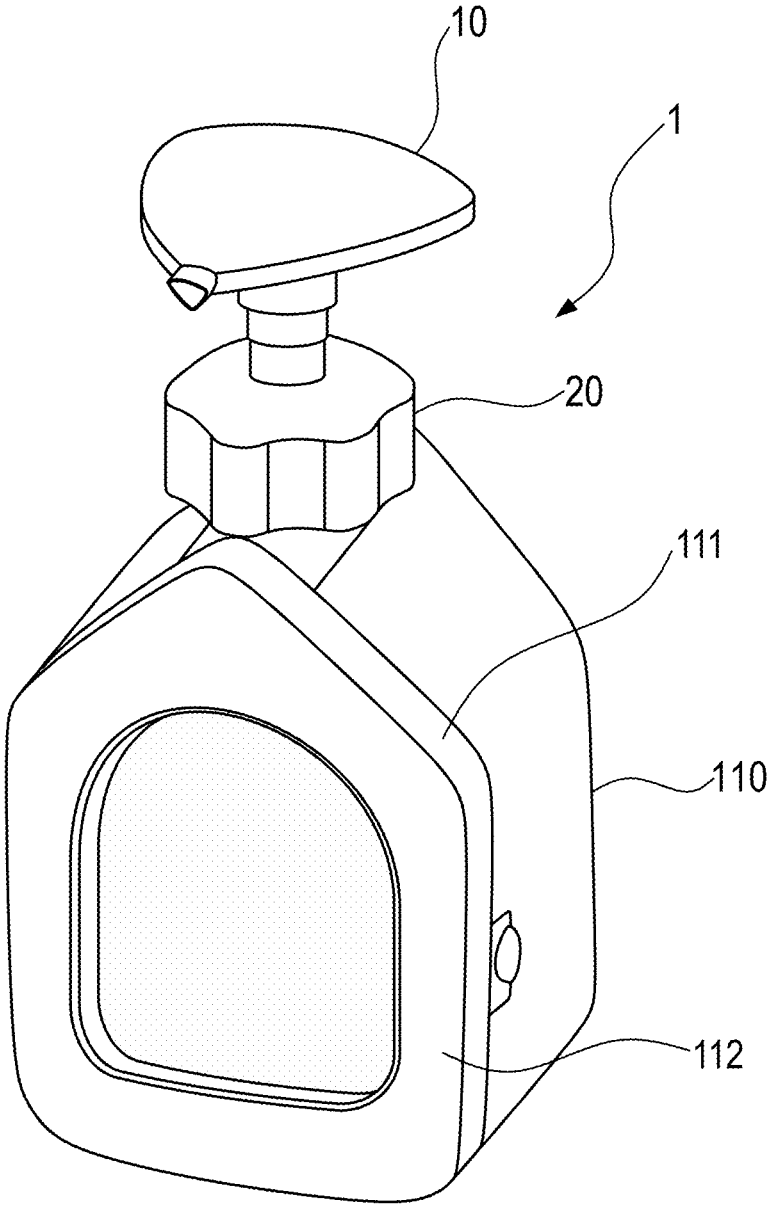
FIG. 5 provides a perspective view of a packaging system comprising a pump dispenser and an outer case as shown and described herein.

FIG. 5 provides a perspective view of a packaging system 1 comprising a pump dispenser 100 and an outer case 110 in a closed position.

The outer case 110 may have a front panel 111 including a front opening 112 for the introduction of the pump dispenser 100 such that the flexible pouch 60 is stored inside the outer case 110. The outer case 110 may have a cavity therein.

Preferably, the front panel 111 may have a front door having a window 113 to see the flexible pouch 60 through the window 113.

Figure 6:
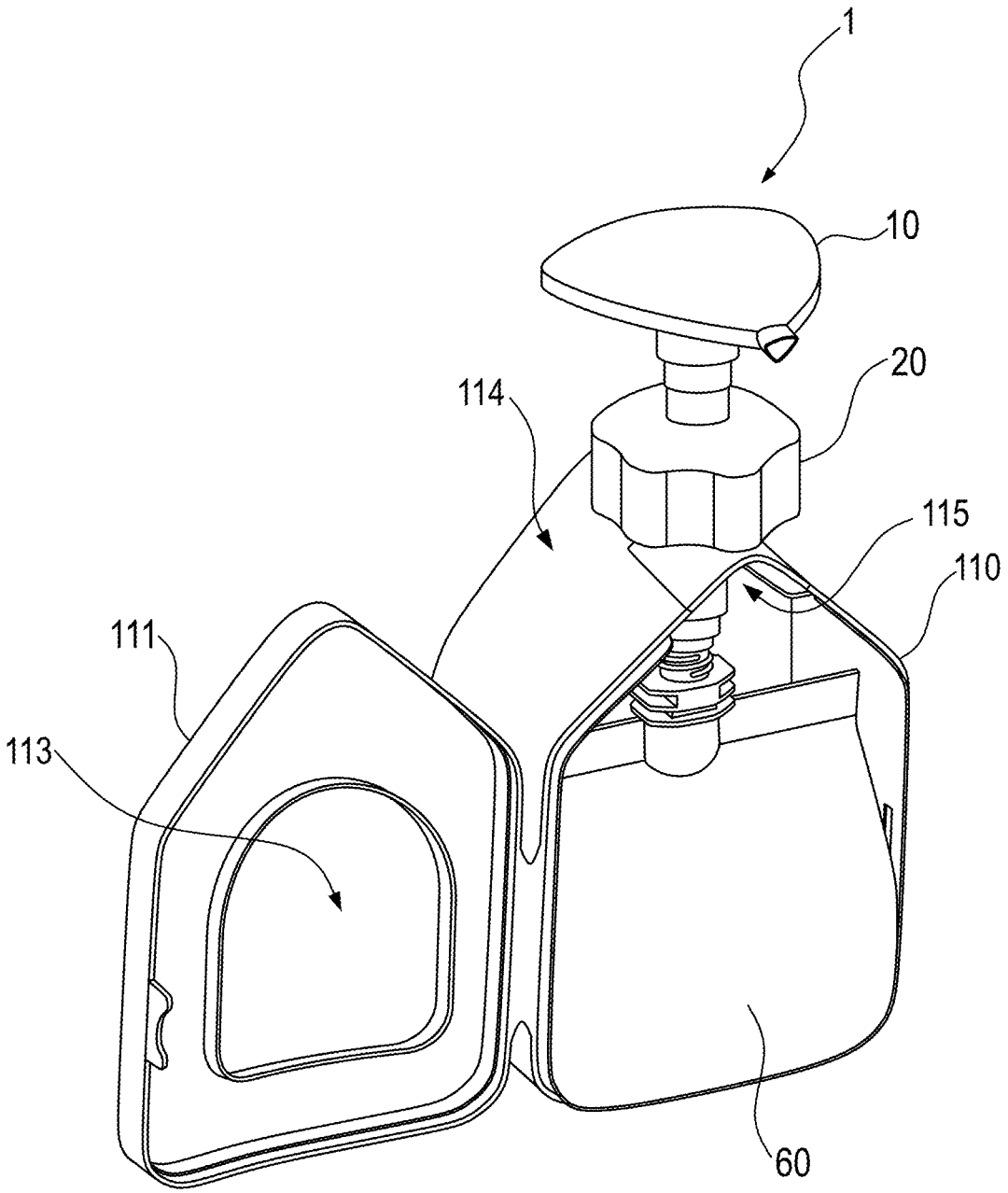
FIG. 6 provides a perspective view of the packaging system of FIG. 5 comprising a pump dispenser and an outer case with a front door open as shown and described herein.

FIG. 6 provides a perspective view of the packaging system 1 of FIG. 5 comprising a pump dispenser 100 and an outer case 110 with a front door open as shown and described herein.

Hence, the outer case 100 which is molded from a single panel may be divided into the front door and the cavity of the outer case 110. The front door is connected to the outer case 110 through hinge sections at side walls. When the front door is in a closed position, a space is formed for containing the flexible pouch 60.

The outer case 111 may also have a top panel 114 having an opening 115 such that the pump dispenser 100 is detachably secured to the outer case 110.

The pump dispenser 100 may be detachably secured to the outer case 110 by connecting the top panel opening 115 to the connecting shell 30 of the pump dispenser 100.

Hence, the outer case 110 may have a top panel 114 forming a top wall. The top panel 114 may have an opening 115 located at the center of the top panel 114. The outer case 110 may have a notch at the opening 115, wherein the notch can be fixed to the connecting shell (30, 30').

The connecting shell 30 may have a fixative element 34 to snap into the opening 115 of the top panel 114 of the outer case 110.

Figure 7:
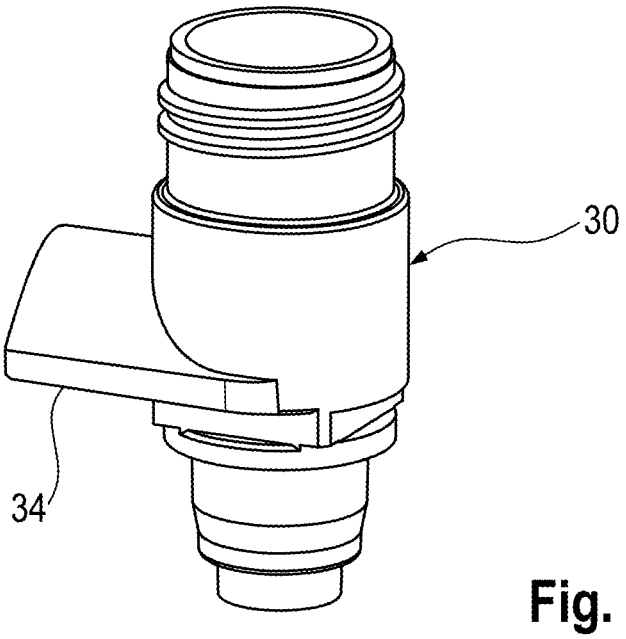
FIG. 7 provides a perspective view of a connecting shell as shown and described herein.
Figure 7A:
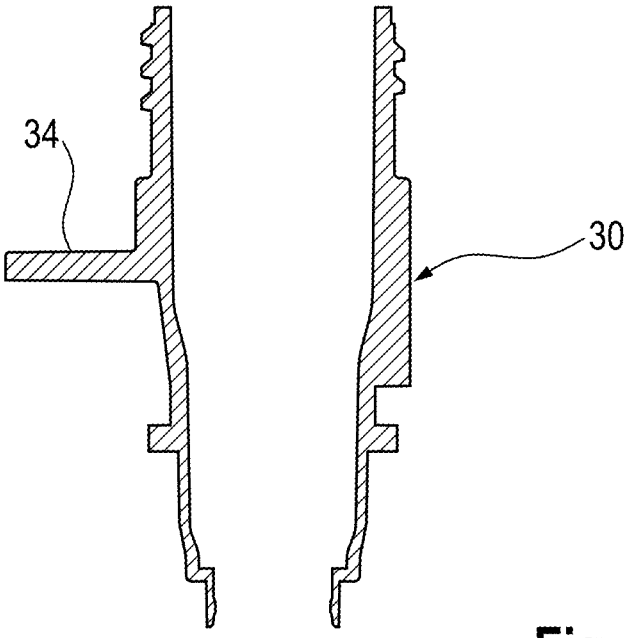
FIG. 7A provides a cross-sectional view of a connecting shell of the pump dispenser according to one or more aspects.

FIGS. 7 AND 7A provide perspective and cross-sectional views of an example of a connecting shell 30. The connecting shell 30 may include a fixative element 34 to snap into the opening 115 of the top panel 114 of the outer case 110.

Figure 8:
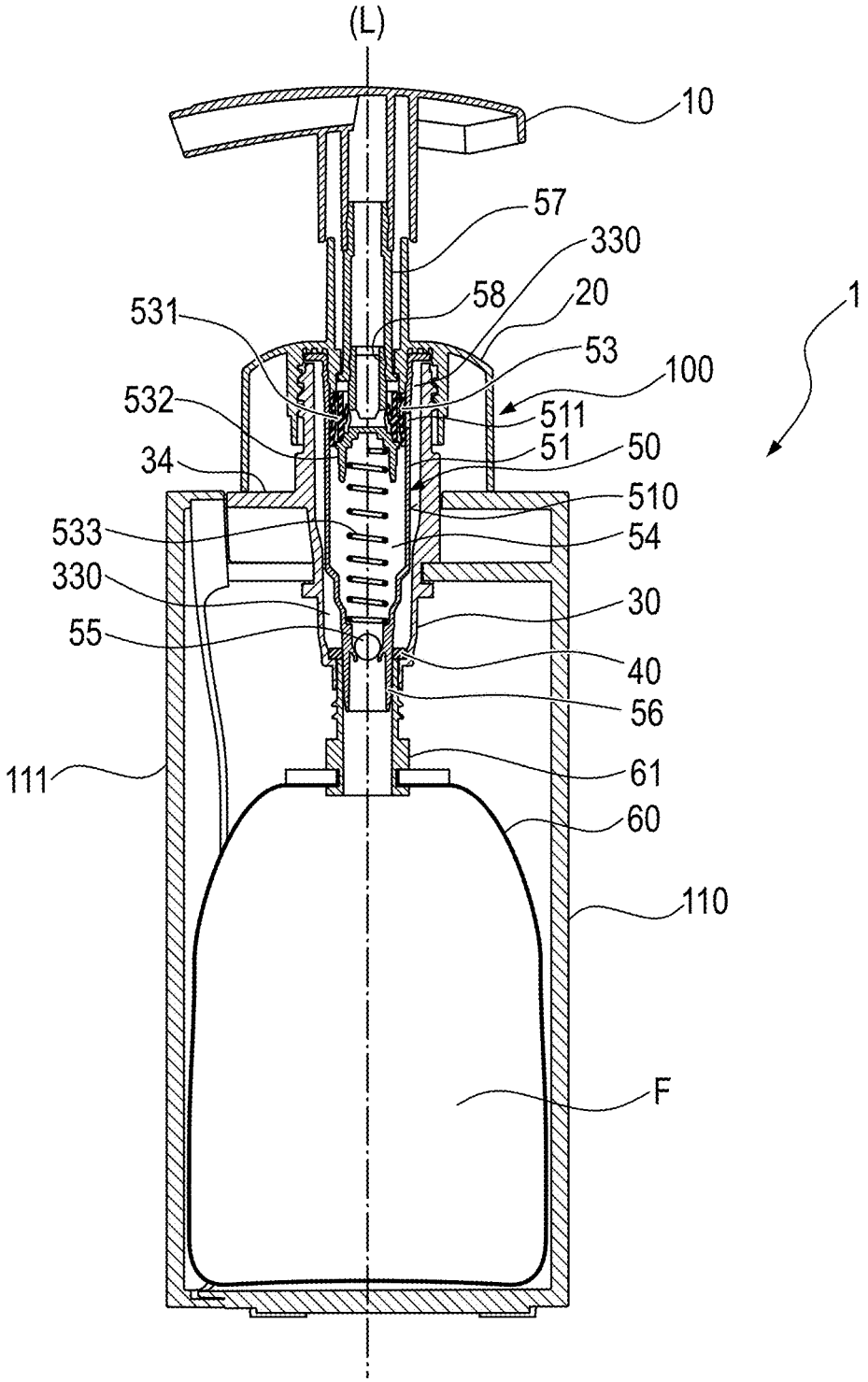
FIG. 8 provides a cross-sectional view of a side view of a packaging system comprising the connecting shell of FIG. 7 as shown and described herein before any use.

FIG. 8 provides a cross-sectional view of a side view of a packaging system comprising the connecting shell of FIG. 7 as shown and described herein before any use.

The notch of the outer case 110 may comprise a groove 116. The fixative element 34 may include stop shelves mating with the groove 116 of the outer case 110 to connect the fixative element 34 to the notch of the outer case 110.

Actuation

Figure 9:
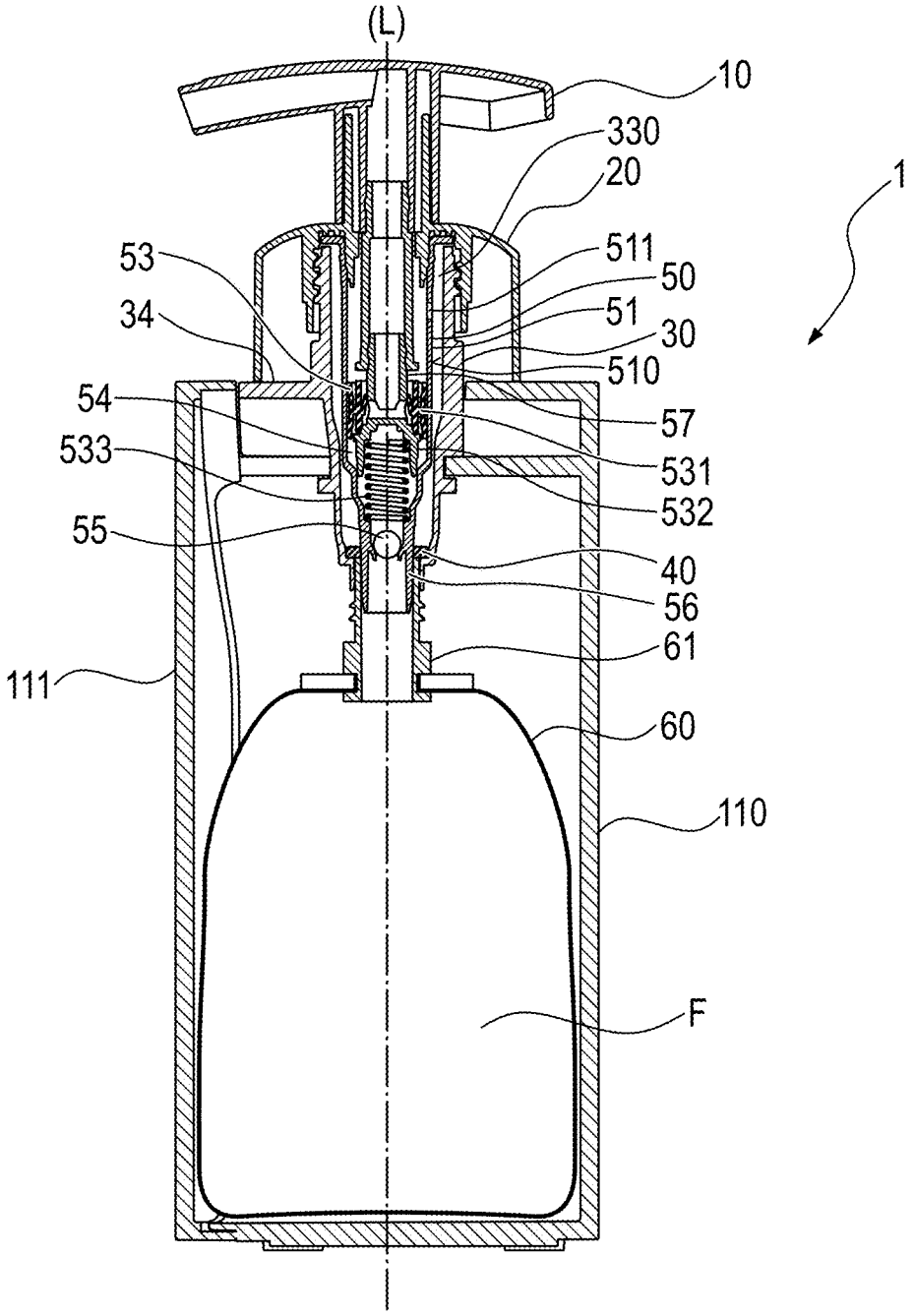
FIG. 9 provides a cross-sectional view of a side view of the packaging system of FIG. 8 when the actuator is pressed down for the first time.
Figure 10:
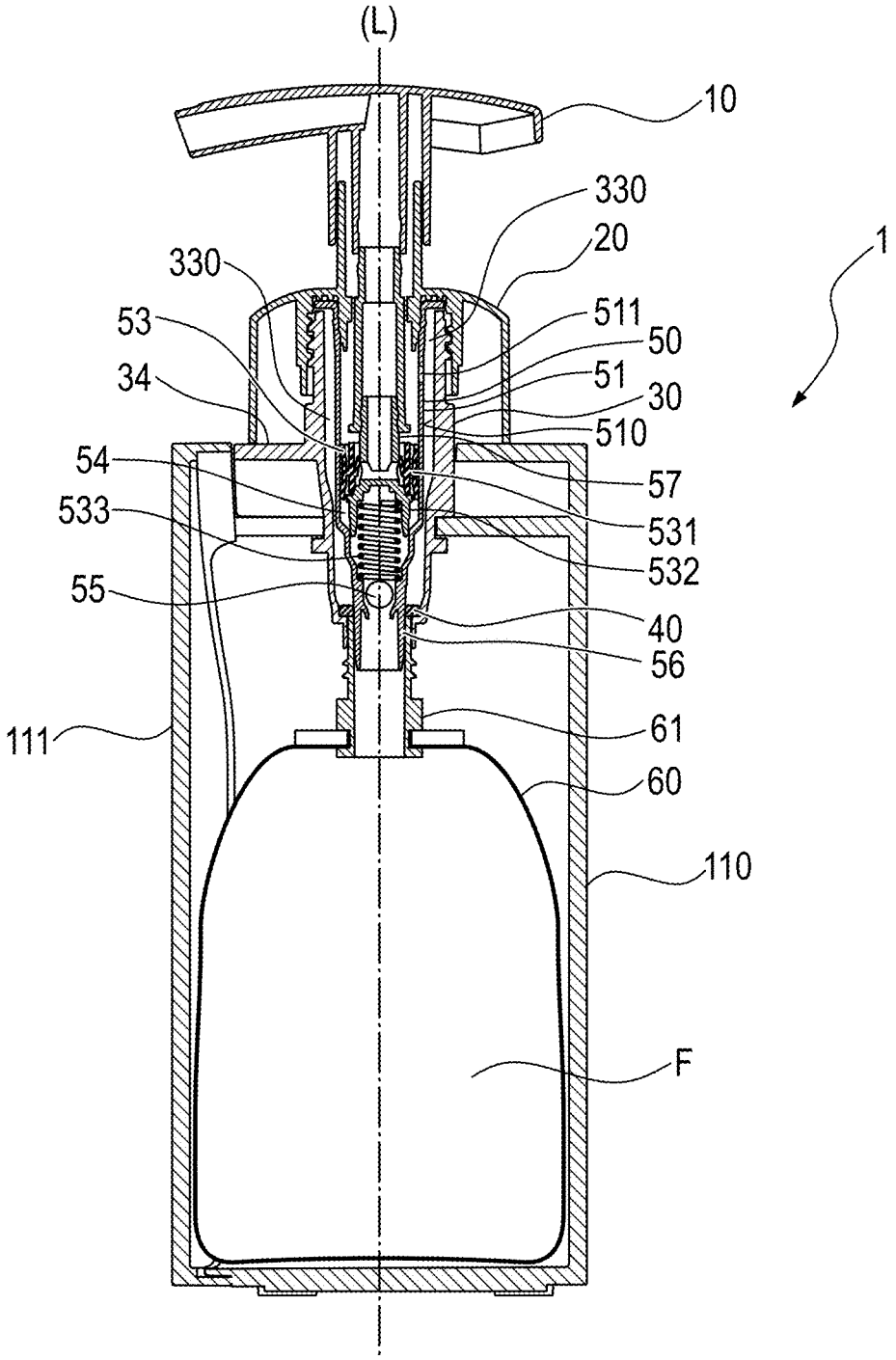
FIG. 10 provides a cross-sectional view of a side view of the packaging system of FIG. 9 when the actuator is being released.

FIGS. 9-10 provide successive cross-sectional views of a pump dispenser 1 including a pump dispenser 100, an outer case 110 and a flexible pouch 60 to show how the actuation occurs.

FIG. 9 provides a cross-sectional view of a side view of the packaging system 1 of FIG. 8 when the actuator 10 is pressed down for the first time.

When the actuator 10 is pushed down for a first time by a user, the piston assembly 53 moves to compress the spring 533. The piston skirt 531 and the piston sub-stem 532 are pushed down and compressed the spring 533 towards the inlet one-way valve 55.

FIG. 10 provides a cross-sectional view of a side view of the packaging system 1 of FIG. 9 when the actuator 10 is being released.

When the actuator 10 is being pressed down and released, air can enter between the actuator 10 and the closure 20 into the cavity of the housing 51. Then air can flow to the air chamber 330 by the air ventilating hole 511. As the piston skirt 531 provides an airtight sealing between the housing 51 and the flexible pouch 60, air is not balanced in the piston assembly 51 and cannot enter the spout 61 of the flexible pouch 60 via a passage through the inlet one-way valve 55 and the port 56.

Air is also not balanced in the flexible pouch 60 because the air chamber 330 is sealed in an airtight manner to the spout 61 of the flexible pouch 60. Hence, the flexible pouch 60 is airtight and/or gradually vacuumed over dispensing usage.

Indeed, the lower portion 320 of the connecting shell 30 is removably engaged with the outer surface 612 of the spout 61 of the flexible pouch 60. The pump assembly 50 is removably engaged with the flexible pouch 60 in an airtight sealing manner.

In FIG. 10 as an example, the port 56 of the pump assembly 50 is removably engaged with the inner surface 611 of the spout 61 of the flexible pouch 60 in an airtight sealing manner. The housing 51 of the pump assembly 50 has the port 56 at the lower end 520 of the housing 51.

The port 56 of the pump assembly 50 may be in interference with the inner surface 611 of the spout 61 of the flexible pouch 60 in an airtight sealing manner.

The connecting shell 30 of the pump dispenser 100 may comprise a sealing piece 40 positioned at a location where the port 56 of the pump assembly 50 is removably engaged with the spout 61 of the flexible pouch 60 such that the spout 61 and the pump assembly 50 are engaged in the airtight scaling manner.

Specifically, the sealing piece 40 may be positioned at a location where the port 56 of the pump assembly 50 is removably engaged with the spout 61 of the flexible pouch 60 such that the spout 61 and the port 56 of the pump assembly 50 are engaged in the airtight sealing manner.

As shown in a FIG. 10, the sealing piece 40 may be positioned around the port 56 of the pump assembly 50 at the spout 61 of the flexible pouch 60 for providing an airtight sealing between the spout 61 of the flexible pouch 60 and the pump assembly 50, specifically for providing an airtight sealing between the spout 61 of the flexible pouch 60 and the port 56 of the pump assembly 50.

Hence, when the actuator 10 is released after pressing it, the sealing piece 40 ensures that air flows from the air ventilating hole 511 of the housing 51 of the pump assembly 50 to the air chamber 330 and not back to the flexible pouch 60. The airtight sealing function, namely by the sealing piece 40, can enable the pump assembly 50 to gradually vacuum the flexible pouch 60. Hence, the flexible pouch 60 can be airtight and/or gradually vacuumed over dispensing usage by using the sealing piece 40 as an airtight means. When the fluid substance F is expelled, the flexible pouch 60 shrinks so that there is no air intake inside the flexible pouch 60.

The inlet one way-valve 55 permits flow in the upstream direction from the flexible pouch 60 to the actuator 100 and prevents flow in the downstream direction.

Figure 11:
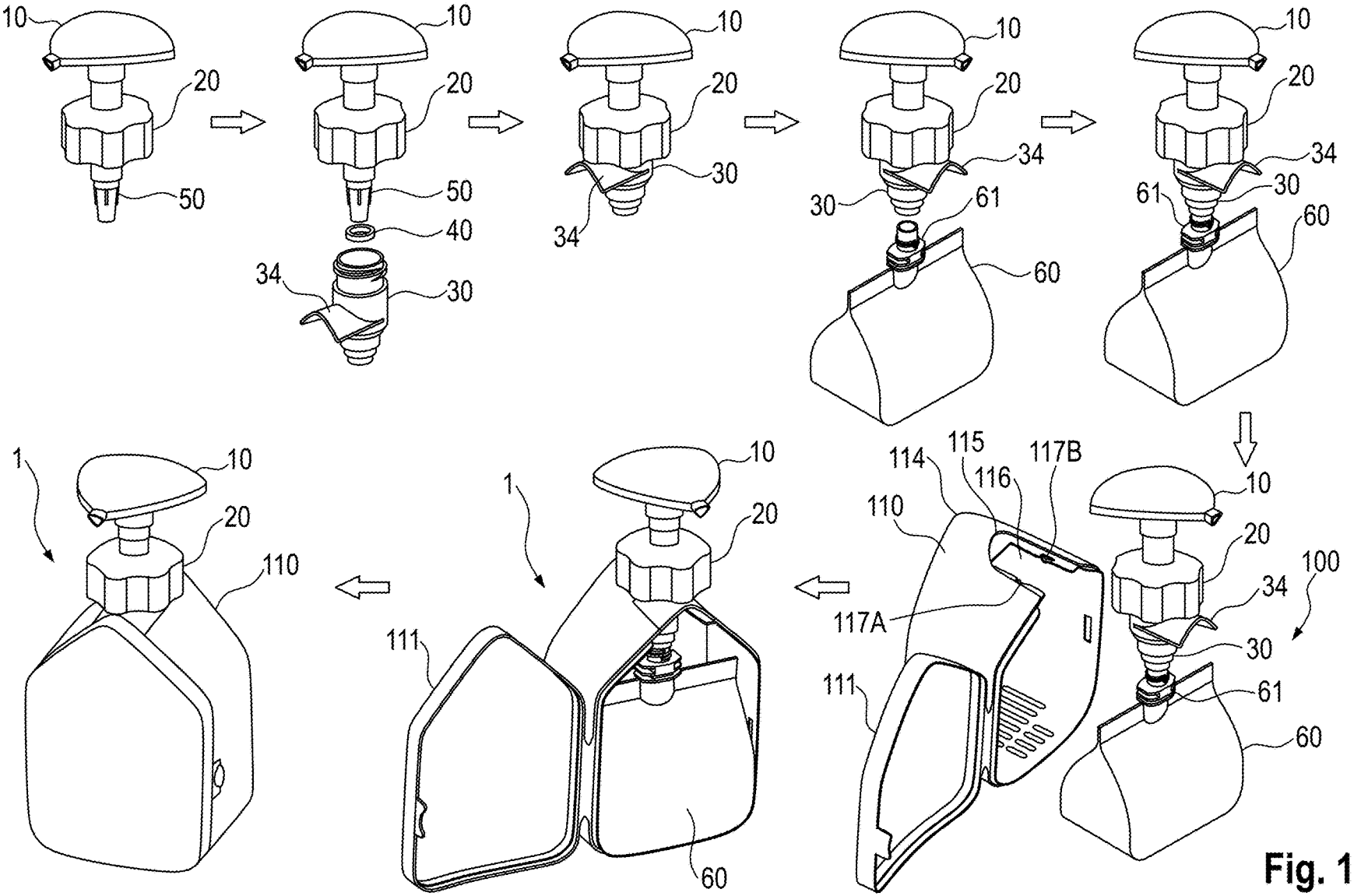
FIG. 11 depicts a schematic representation showing how the packaging system is mounted, namely how the pump dispenser is inserted in the connecting shell and engages with the flexible pouch before being stored inside the outer case.

FIG. 11 show how the different components of the packaging system 1 can be assembled and connected together.

Firstly, a pump assembly 50 is provided and includes an actuator 10 and a closure 20 connected to the actuator 10. A sealing piece 40, as an example of an airtight sealing means, may be inserted at a port 56 of the pump assembly 50.

Then, a connecting shell 30 is engaged to the closure 20 of the pump assembly 50. For this, the closure 20 of the pump assembly 50 is coupled to a neck 31 of the connecting shell 30. The closure 20 of the pump assembly 50 is threadingly engaged with the neck 31 of the connecting shell 30, as shown in FIG. 11. The closure 20 may have inner threads 210. The inner threads 210 of the closure 20 may engage with the outer threads 311 of the neck 31 of the connecting shell 30 to secure the pump assembly 50 to the connecting shell 30.

Then, the flexible pouch 60 is secured to the pump assembly 50 and the connecting shell 30. For this, as set out above, the lower portion 320 of the connecting shell 30 is removably engaged with the outer surface 612 of the spout 61 of the flexible pouch 60. The connecting shell 30 has the lower end 321 at the lower portion 320 of the connecting shell 30. In that instance, the lower end 321 of the connecting shell 30 may be removably engaged with the outer surface 612 of the spout 61 of the flexible pouch 60. Namely, the lower end 321 of the connecting shell 30 may be in interference with the outer surface 612 of the spout 61 of the flexible pouch 60.

The pump assembly 50 is removably engaged with the flexible pouch 60 in an airtight sealing manner. In that example, the port 56 of the pump assembly 50 is removably engaged with the inner surface 611 of the spout 61 of the flexible pouch 60 in an airtight sealing manner. As said above, the housing 51 of the pump assembly 50 has the port 56 at the lower end 520 of the housing 51. In that example, the port 56 of the pump assembly 50 may be in interference with the inner surface 611 of the spout 61 of the flexible pouch 60 in an airtight sealing manner.

As shown in a FIG. 11, the connecting shell 30 of the pump dispenser 100 may comprise a sealing piece 40 positioned at a location where the port 56 of the pump assembly 50 is removably engaged with the spout 61 of the flexible pouch 60 such that the spout 61 and the pump assembly 50 are engaged in the airtight sealing manner.

Specifically, the sealing piece 40 may be positioned at a location where the port 56 of the pump assembly 50 is removably engaged with the spout 61 of the flexible pouch 60 such that the spout 61 and the port 56 of the pump assembly 50 are engaged in the airtight sealing manner.

Hence, the sealing piece 40 may be positioned around the port 56 of the pump assembly 50 at the spout 61 of the flexible pouch 60 for providing an airtight sealing between the spout 61 of the flexible pouch 60 and the pump assembly 50, specifically for providing an airtight sealing between the spout 61 of the flexible pouch 60 and the port 56 of the pump assembly 50 to lead to the pump dispenser 100.

Then, an outer case 110 is provided for storing the pump dispenser 100 and the flexible pouch 60. The outer case 110 has a front panel 111 including a front opening 112 for the introduction of the pump dispenser 100 such that the flexible pouch 60 is stored inside the outer case 110. The outer case 110 may have a cavity therein.

The outer case 111 also has a top panel 114 having an opening 115 such that the pump dispenser 100 is detachably secured to the outer case 110.

The pump dispenser 100 may be detachably secured to the outer case 110 by connecting the top panel opening 115 to the connecting shell 30 of the pump dispenser 100.

The outer case 110 has a top panel 114 forming a top wall. The top panel 114 has an opening 115 located at the center of the top panel 114. The outer case 110 has a notch at the opening 115, wherein the notch can be fixed to the connecting shell 30.

As shown in a FIG. 11, the connecting shell 30 has a fixative element 34 to snap into the opening 115 of the top panel 114 of the outer case 110.

The notch of the outer case 110 may comprise a groove 116. The fixative element 34 may include stop shelves mating with the corresponding notched (117A, 117B) of the groove 116 of the outer case 110 to connect the fixative element 34 to the notch of the outer case 110.

The front door of the outer case 110 may be close to lead to a closed version of the packaging system 1.

Hence, the packaging system 1 is relatively convenient to insert and replace a flexible pouch 60 at the end of dispensing usage.

Alternative Packaging System

The packaging system 1 may further comprise an outer case 110 for storing an alternative pump dispenser 100 and the flexible pouch 60.

Figure 12:
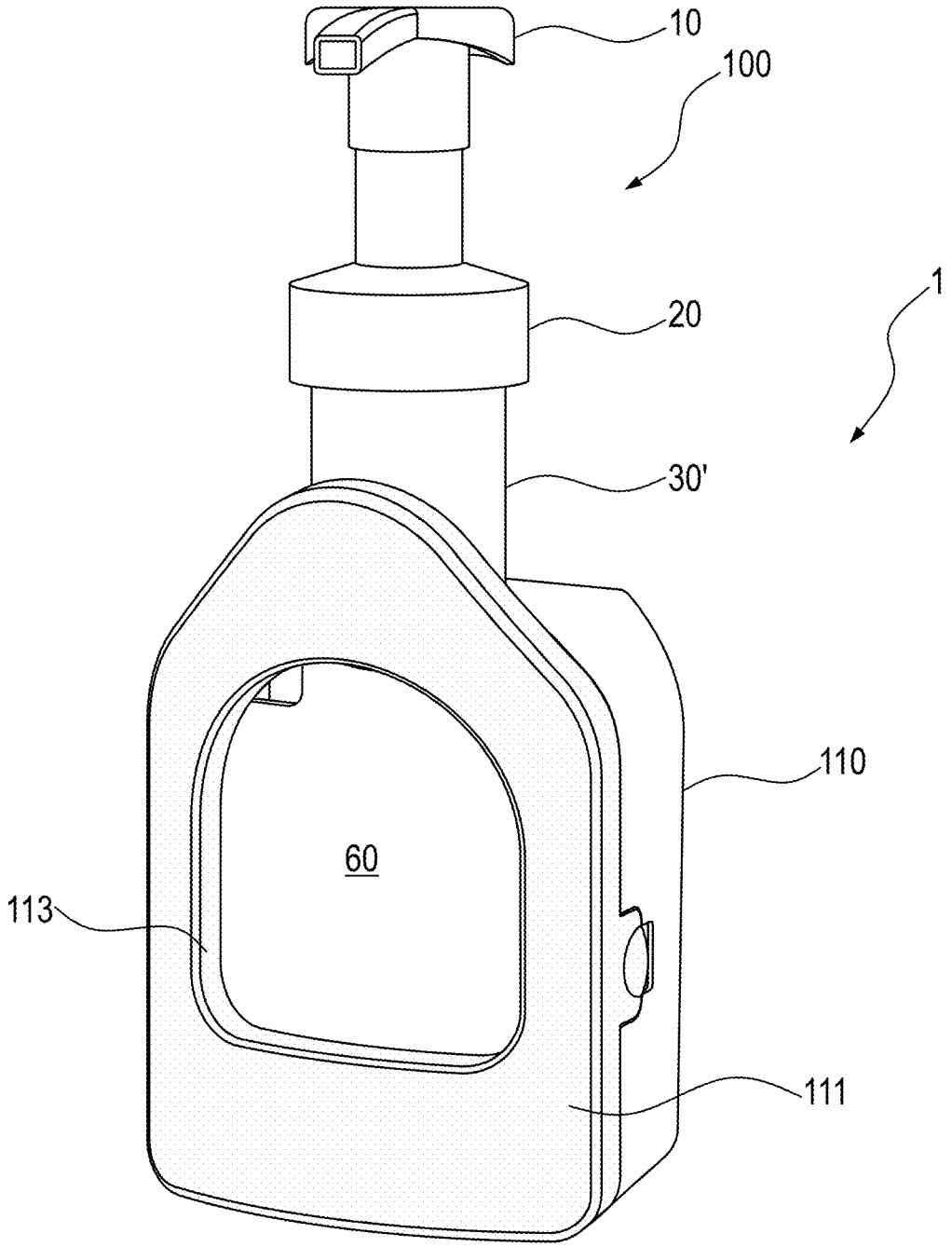
FIG. 12 provides a perspective view of another packaging system comprising an alternative pump dispenser and an outer case as shown and described herein.

FIG. 12 provides a perspective view of another packaging system 1 comprising an alternative pump dispenser 100 and an outer case 110 in a closed position.

The outer case 110 may have a front panel 111 including a front opening 112 for the introduction of the pump dispenser 100 such that the flexible pouch 60 is stored inside the outer case 110. The outer case 110 may have a cavity therein.

Preferably, the front panel 111 may have a front door having a window 113 to see the flexible pouch 60 through the window 113.

The alternative pump dispenser 100 may comprise a foaming pump assembly 50', a flexible pouch 60 and a connecting shell 30'. Such alternative pump dispenser 100 is described herein above and shown in a FIG. 4.

The foaming pump assembly 50' includes an actuator 10 having a cavity therein; and a closure 20 connected to the actuator 10.

Figure 13:
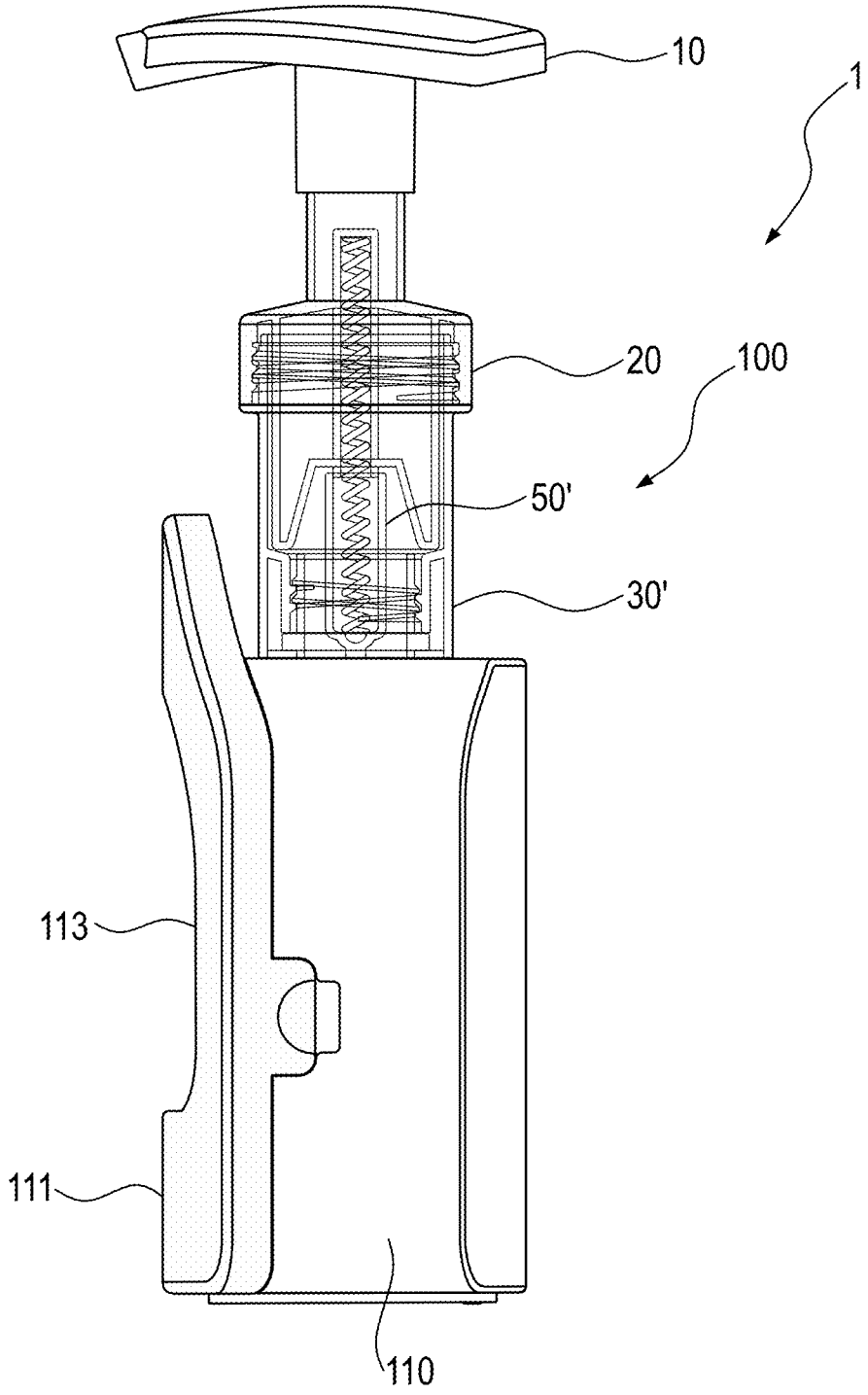
FIG. 13 provides a side view of the packaging system of FIG. 12 with a transparent connecting shell and foaming pump assembly as shown and described herein before any use.

FIG. 13 provides a side view of the packaging system of FIG. 12 with a transparent connecting shell 30' and foaming pump assembly 50' as shown and described herein before any use.

Figure 14:
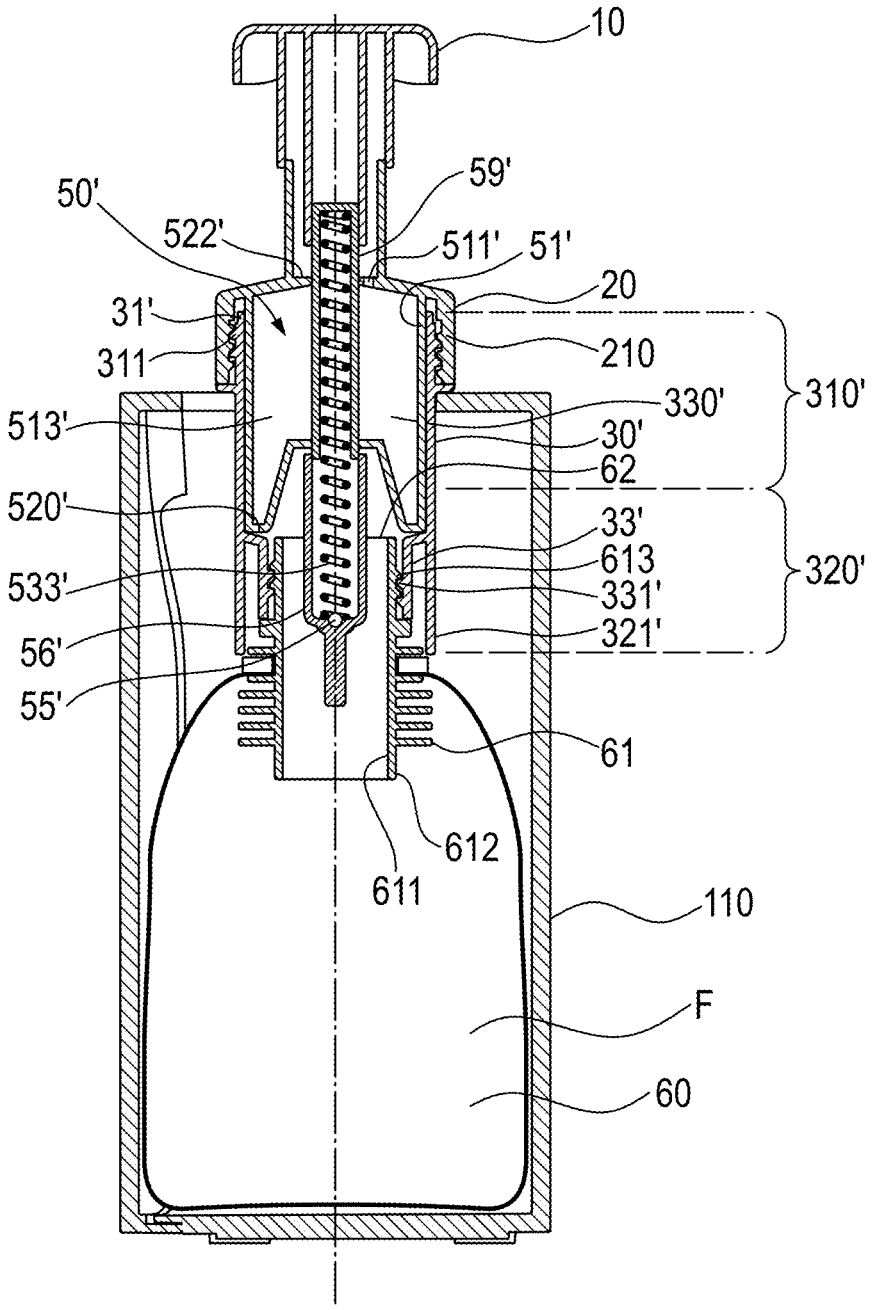
FIG. 14 provides a cross-sectional view of a side view of the packaging system of FIG. 12 as shown and described herein before any use.

FIG. 14 provides a cross-sectional view of a side view of the packaging system of FIG. 12 as shown and described herein before any use.

The connecting shell 30' has a cavity therein. The connecting shell 30' has an upper portion 310' and a lower portion 320'. The connecting shell 30' has a lower end 321'.

The connecting shell 30' of the pump dispenser 100 may have an open top and an open bottom. The connecting shell 30' of the pump dispenser 100 may have a side wall having an outer surface and an inner surface.

The connecting shell 30' may have a sleeve 33' having a cavity therein and protruding from the side wall of the connecting shell 30', at the lower portion 320' of the connecting shell 30', wherein the sleeve 33' may have inner threads 331'.

The connecting shell 30' may have a generally hollow cylindrical shape.

Figure 15:
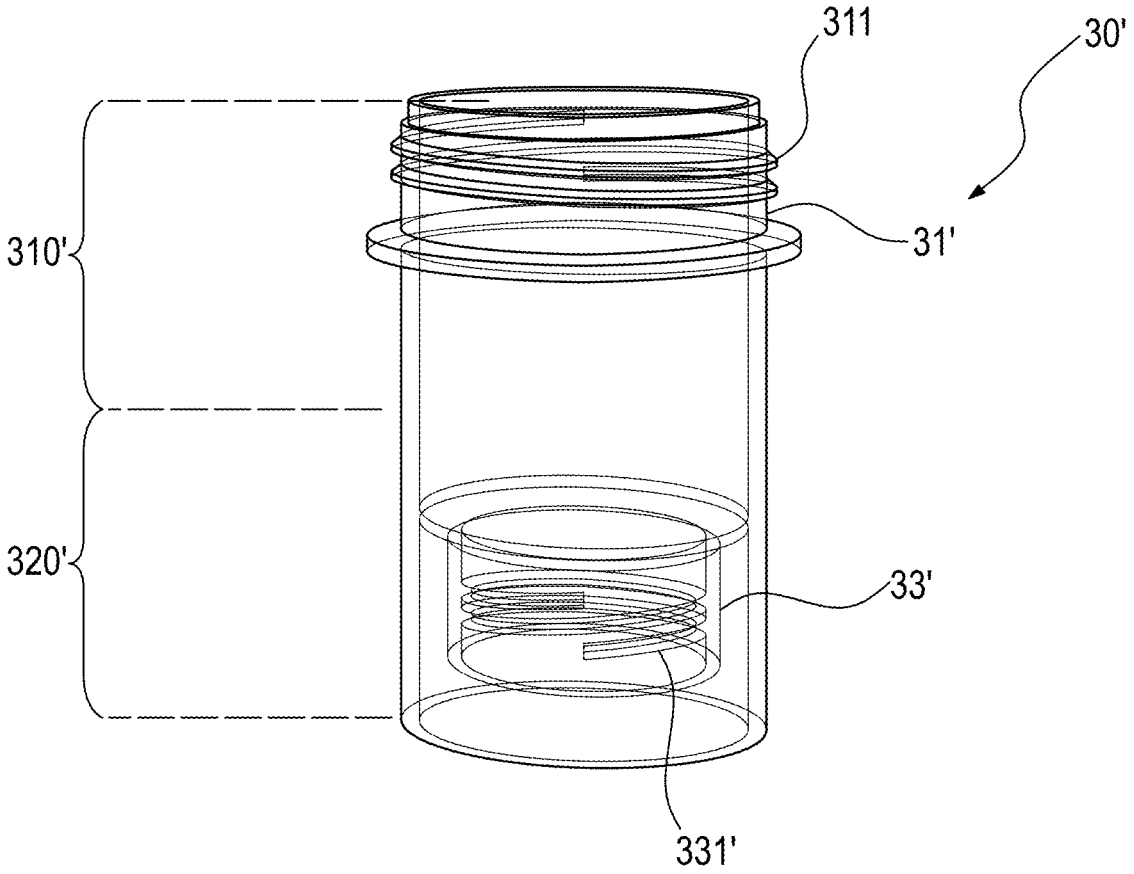
FIG. 15 provides a perspective, and transparent front view of another connecting shell of FIG. 13 as shown and described herein.

FIG. 15 provides a perspective, and transparent front view of another connecting shell 30' of FIG. 13 as shown and described herein.

The connecting shell 30' may be a double cylinder formed integrally having an upper cylinder to receive the foaming pump assembly and a lower cylinder, wherein the lower cylinder forms the sleeve 33' of the connecting shell 30'. The upper and lower cylinders of the connecting shell 30' are formed concentrically with each other.

The connecting shell 30' may have a neck 31' having a neck landing zone at the upper portion 310' of the connecting shell 30'. The neck 31' of the connecting shell 30' may preferably have outer threads 311'.

More specifically, the closure 20 of the foaming pump assembly 50' may be coupled to the neck 31' of the connecting shell 30'. The closure 20 of the foaming pump assembly 50' may be threadingly engaged with the neck 31' of the connecting shell 30'. The closure 20 may have inner threads 210. The inner threads 210 of the closure 20 may engage with the outer threads 311' of the neck 31' of the connecting shell 30' to secure the foaming pump assembly 50' to the connecting shell 30'.

The foaming pump assembly 50' of the pump dispenser 100 has an housing 51' having an outer surface and an inner surface. The housing 51' has a lower end 520' and an upper end 522'.

The housing 51' of the foaming pump assembly 50' may have an open top and an open bottom. The open top of the housing 51' is located at the upper end of the housing 51'. The open bottom of the housing 51' is located at the lower end of the housing 51'. The housing 51' of the foaming pump assembly 50' has a side wall having the outer surface and the inner surface. The upper end of the housing 51' may be co-extruded with the closure 20 to form one single piece. Thus, the housing 51' and the closure 20 may be integrally formed. The housing 51' of the foaming pump assembly may be interior to the connecting shell 30' of the pump dispenser 100.

The foaming pump assembly 50' may include a liquid piston 59'. The liquid piston 59' may have a generally hollow cylindrical shape. The liquid piston 59' may have a closed upper end and an open lower end, wherein the closed upper end receives a spring 533'. The liquid piston 59' may be press-fitter in a rod portion of the actuator 10 and through the housing 51'. Thus, the actuator 10 and the liquid piston 59' can move up and down integrally.

The housing 51' of the foaming pump assembly 50' may form an air chamber 513'. The housing 51' of the foaming pump assembly may include an air ventilating hole 511', preferably located at an upper portion of the housing 51'.

As the housing 51' and the closure 20 may be integrally formed, the air ventilating hole 511' may be located at the closure 20; and at or at proximity of the liquid piston 59' at the upper portion 310' of the connecting shell 30.

The air ventilating hole 511' of the housing 51' of the foaming pump assembly 50' can help to balance air in the air chamber 513' when the fluid substance F is dispensed from the pump dispenser 100.

Alternatively, the housing 51' may include no air ventilating hole 511'. As the pouch 60 is flexible, the flexible pouch 60 can still be vacuumed gradually over dispensing usage.

The housing 51' of the foaming pump assembly 50' has a port 56' at the lower end 520 of the housing 51'. The port 56' may have a generally hollow cylindrical shape and include an annular seat portion converging downwardly at a lower end of the port 56'.

The lower cylinder of the housing 51' may provide the annular seat portion as a funnel-shaped valve seat portion for receiving an inlet one-way valve 55'.

The port 56' may have an open upper end having a diameter greater that a diameter of the open lower end of the liquid piston 59' such that the upper end of the port 56' closes the lower end of the liquid piston 59'. Hence, the spring 533' is positioned between the closed upper end of the liquid piston 59' and the annular seat portion of the port 56'.

The connecting shell 30', the foaming pump assembly 50' and the flexible spout 60 of the pump dispenser 100 may be connecting as follows:

The lower portion 320' of the connecting shell 30' may be removably engaged with the outer surface 612 of the spout 61 of the flexible pouch 60.

The spout 61 of the flexible pouch 60 may comprise outer threads 613 on the outer surface 612. The inner threads 331' of the sleeve 33' of the connecting shell 30' at the lower portion 320' may engage with the outer threads 613 of the spout 61 of the flexible pouch 60 to removably secure the connecting shell 30' to the flexible pouch 60 in the airtight sealing manner.

The foaming pump assembly 50' is removably engaged with the flexible pouch 60 in the airtight sealing manner. This is due to the fact that the inner threads 331' of the sleeve 33' of the connecting shell 30' at the lower portion 320' engage with the outer threads 613 of the spout 61 of the flexible pouch 60. When the actuator 10 is pushed down and released by a user, air is only balanced in the air chamber 513' by the air ventilating hole 511' of the housing 51' and air is not balanced in the flexible pouch 60.

Hence, the flexible pouch 60 is airtight and/or gradually vacuumed over dispensing usage.

Dip Tube

As set out above, the pump dispenser 100 shall not comprise any dip tube for optimizing hygiene properties of the pump dispenser 100. Contamination might occur when inserting a pump dispenser 100 and dip tube into a new flexible pouch 60. Without any dip tube, any contamination that might come from the dip tube into a new flexible pouch 60 can be prevented.

However, when the fluid substance F is relatively high viscous, it has been observed that product residues remained in the flexible pouch 60 at the end of dispensing usage. Such product residues could not be expelled although the flexible pouch 60 was gradually vacuumed over dispensing usage and could shrink.

The pump dispenser 100 may include a dip tube 70. Preferably, the flexible pouch may comprise a relatively high viscous fluid substance F. More preferably, the fluid substance F may have a viscosity from 6 Pa·s (6000 cps) to 200 Pa·s (200000 cps) or from 12 Pa·s (12000 cps) to 70 Pa·s (70000 cps) as measured on a 2.5 mL sample using a one and plate Brookfield RS rheometer with cone C75-1 at constant shear rate of 2 $s^{-1}$ at 27 °C at 3 mins.

When the pump dispenser 100 includes a dip tube 70 for a relatively high viscous fluid substance, it has been found that versus the same pump dispenser comprising no dip tube, less product residue of the fluid substance F remained in the flexible pouch 60 at the end of the dispensing usage, as shown in Table 1.

TABLE 1

| Product viscosity | Product residue at the end of dispensing usage Pump dispenser without any dip tube | Product residue at the end of dispensing usage Pump dispenser with a dip tube |
|---|---|---|
| 70 Pa · s (70000 cps) | 19.4% | 4.8% |
| 40 Pa · s (40000 cps) | 14.9% | 3.6% |
| 12 Pa · s (12000 cps) | 6.3% | 3.2% |

Figure 16:
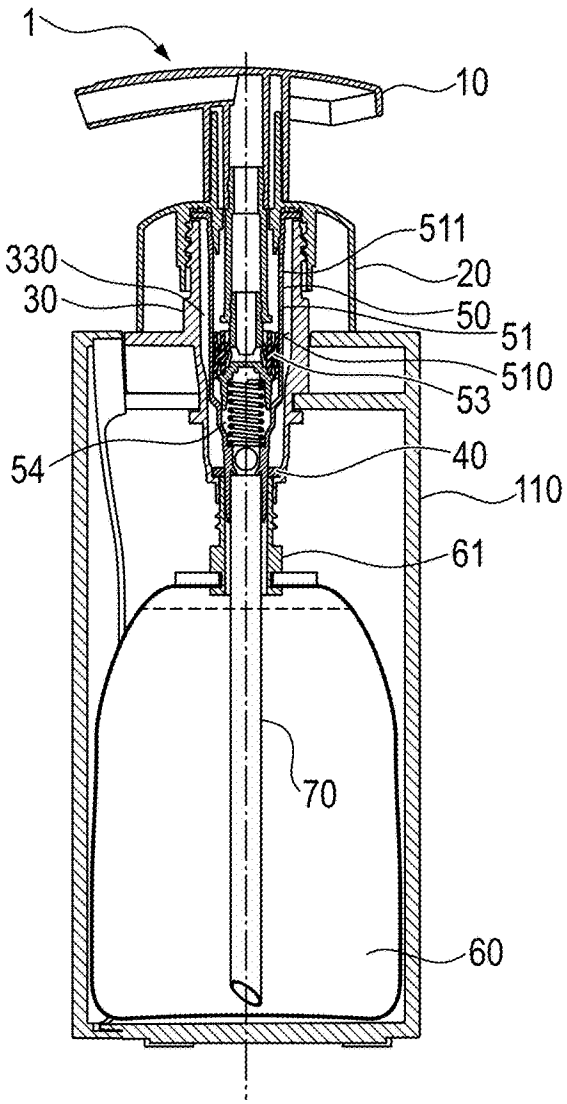
FIG. 16 provides a cross-sectional view of a side view of a packaging system when the pump dispenser includes a dip tube and when the actuator is pressed down for the first time.

FIG. 16 provides a cross-sectional view of a side view of a packaging system 1 when the pump dispenser 100 includes a dip tube 70 and when the actuator 10 is pressed down for the first time.

In that alternative aspect, the pump assembly 50 of the pump dispenser 100 may include a dip tube 70. The port 56 of the pump assembly 50 may be connected to the dip tube 70. The dip tube 70 may be inserted in the port 56, for instance.

The dip tube 70 may provide for fluid communication between the fluid substance F in a form such as a liquid or gel contained in the flexible pouch 60 and the actuator 10. The dip tube 70 may have a lower end that resides in the fluid substance F in the flexible pouch 60 and an upper end that is connected to the port 56 of the pump assembly 50. The dip tube 70 may be ordinary flexible plastic tubing.

Figure 18:
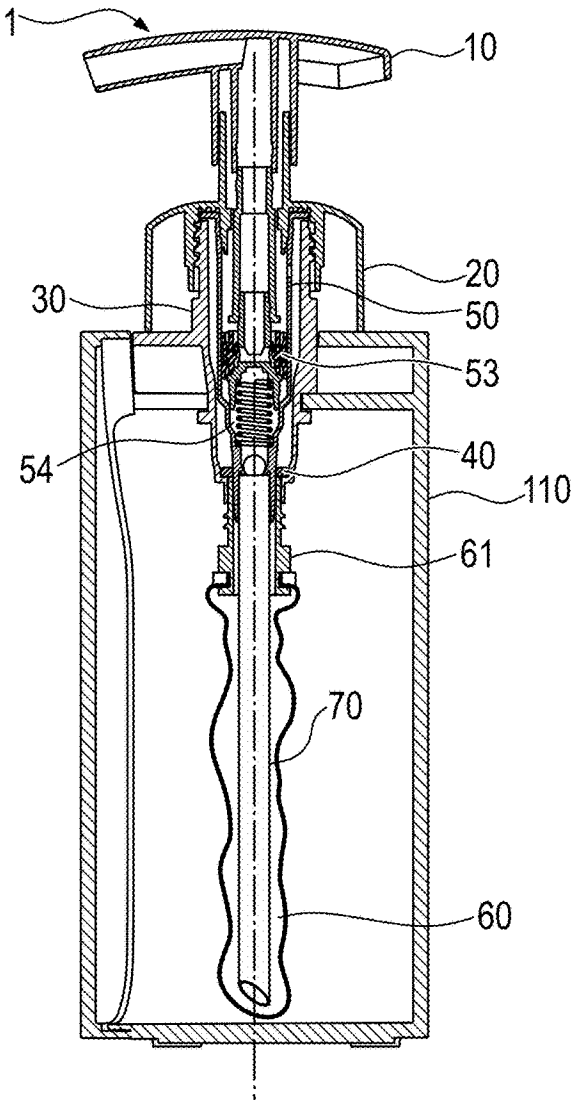
FIG. 18 provides a cross-sectional view of the packaging system of FIG. 17 when the actuator has been pressed and released several times and the flexible pouch is shrunk.
Figure 17:
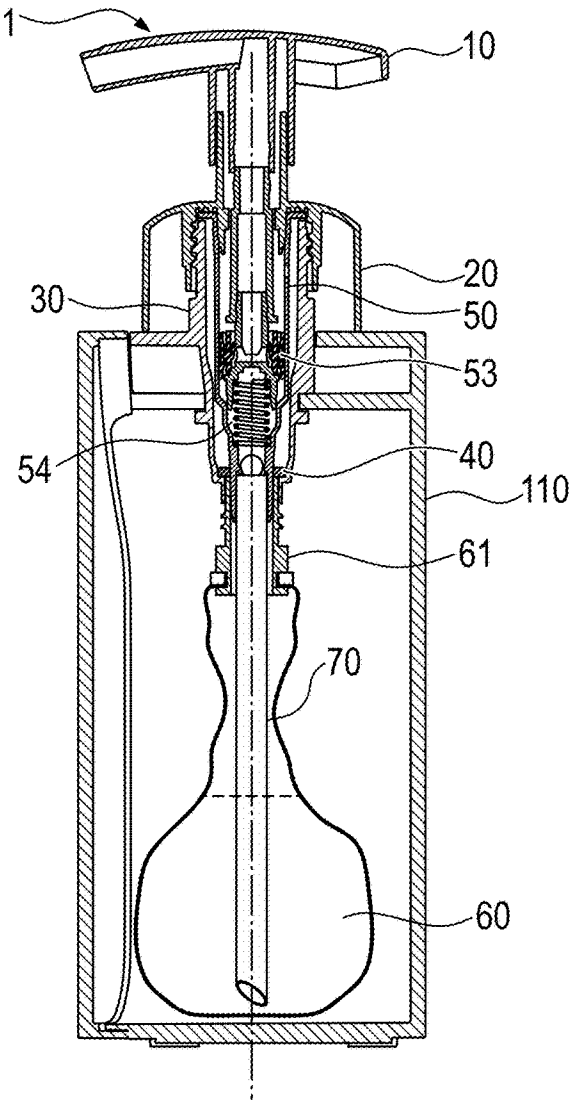
FIG. 17 provides a cross-sectional view of the packaging system of FIG. 17 when the actuator is released and the flexible pouch starts shrinking.

FIG. 18 provides a cross-sectional view of the packaging system 1 of FIG. 17 when the actuator 10 is released and the flexible pouch 60 starts shrinking.

FIG. 19 provides a cross-sectional view of the packaging system of FIG. 17 when the actuator 10 has been pressed and released several times and the flexible pouch 60 is shrunk.

When the flexible pouch 60 is gradually vacuumed over dispensing usage, the flexible pouch 60 shrinks and the fluid substance F is sucked and transported through the dip tube 70 towards the actuator 10. Less product residue remained at the end of the dispensing usage. Hence, the pump dispenser 100 comprising a dip tube 70 can help to dispense any fluid product F with a relatively high viscosity in an efficient manner by delivering much lower product residue at the end of the dispensing usage.

Fluid Substance

The fluid substance F to be dispensed from the flexible pouch 60 may be a consumer product, alternatively a cleaning composition to be applied on a surface of interest. The fluid substance F may be a liquid or a gel; and may be a cleansing composition in a form of a hair shampoo, a hair conditioner composition, a liquid detergent composition, a fabric care composition or a fabric softener, a shower or bath cream, a body wash or foaming body wash, or a liquid hand soap or foaming liquid hand soap.

Preferably, the surface of interest may be hair when the composition is a cleaning composition in the form of a hair shampoo, or a hair conditioner; alternatively skin when the cleaning composition is in the form of a personal care product such as a shower or bath cream, a body wash or foaming body wash; alternatively fabrics such as a liquid detergent or a fabric softener. Most preferably the surface of interest may be skin.

The product forms contemplated for purposes of defining the cleansing compositions are rinse-off formulations by which it is meant that the product is applied topically to the skin or hair and then subsequently (i.e., within minutes) rinsed away with water, or otherwise wiped off using a substrate or other suitable removal means.

Alternatively, the fluid substance F may be a leave-on product like, for example, a hand sanitizer, a facial moisturizer, or a body lotion.

The fluid substance F may be alternatively a body lotion. The body lotion typically has an aqueous and oily phases, an emulsifier to prevent separation of the two aqueous and oily phases, and a benefit agent. A suitable benefit agent may be niacinamide.

Alternatively, the fluid substance F may be a personal cleansing composition, wherein the personal cleansing composition is selected from the group consisting of a liquid hand washing composition, a liquid body washing composition, a liquid hair washing composition, and combinations thereof.

The personal cleansing composition such as a body wash, a hand liquid soap or a hair shampoo may comprise a surfactant system, and a benefit agent. For a body wash, a benefit agent may be petrolatum, mineral oil or a vegetable oil, e.g. soybean oil to provide moisturization onto skin.

Alternatively, the fluid substance F may be a hair shampoo, wherein the hair shampoo comprises a cationic polymer such a cationic guar polymer, conditioning agents (including hydrocarbon oils, fatty esters, silicones), anti-dandruff actives, and chelating agents. Additional suitable optional ingredients include but are not limited to particles, antimicrobials, foam boosters, anti-static agents, moisturizing agents, propellants, self-foaming agents, pearlescent agents, opacifiers, sensates, suspending agents, solvents, diluents, anti-oxidants, vitamins, and mixtures thereof.

Conditioning agents (including hydrocarbon oils, fatty esters, silicones), anti-dandruff actives, or sensitive ingredients may be included in the fluid substance F.

The cationic polymer may be selected from the group consisting of Polyquaternium-6, Polyquaternium-10, cationic guars, and mixtures thereof.

Alternatively, the fluid substance F may be a hair conditioner composition, wherein the hair conditioner composition comprises:

(a) a cationic surfactant, a high melting point fatty compound; a silicone compound; and (b) a carrier.

Cationic surfactants may be those having a longer alkyl group, i.e., $C_{18}$-$C_{22}$ alkyl group, for example, behenyl trimethyl ammonium chloride, methyl sulfate or ethyl sulfate, and stearyl trimethyl ammonium chloride, methyl sulfate or ethyl sulfate.

Alternatively, cationic surfactants may be tertiary amidoamines having an alkyl group of from 12 to 22 carbon atoms, preferably from 16 to 22 carbon atoms. Exemplary tertiary amido amines include: stearamidopropyldimethylamine, stearamidopropyldiethylamine, stearamidoethyldiethylamine, stearamidoethyldimethylamine, palmitamidopropyldimethylamine, palmitamidopropyldiethylamine, palmitamidoethyldiethylamine, palmitamidocthyldimethylamine, behenamidopropyldimethylamine, behenamidopropyldiethylamine, behenamidoethyldiethylamine, behenamidoethyldimethylamine, arachidamidopropyldimethylamine, arachidamidopropyldiethylamine, arachidamidoethyldiethylamine, arachidamidoethyldimethylamine, diethylaminoethylstearamide. Useful amines are disclosed in U.S. Pat. No. 4,275,055, Nachtigal, et al.

Alternatively, cationic surfactants may include di-alkyl cationic surfactants, for example, dialkyl (14-18) dimethyl ammonium chloride, ditallow alkyl dimethyl ammonium chloride, dihydrogenated tallow alkyl dimethyl ammonium chloride, distearyl dimethyl ammonium chloride, or dicetyl dimethyl ammonium chloride.

The high melting point fatty compound as used herein is a fatty compound having a melting point of 25 °C or higher, preferably 40 °C or higher, more preferably 50 °C or higher. The high melting point fatty compound may be selected from the group consisting of fatty alcohols, fatty acids, fatty alcohol derivatives, fatty acid derivatives, and mixtures thereof.

Typical fatty alcohols may be selected from the group consisting of pure cetyl alcohol, stearyl alcohol, behenyl alcohol, and mixtures thereof.

Silicone compounds useful herein may also include amino substituted materials. Preferred aminosilicones may include, for example, those which conform to the general formula (I):

$$(R_1)_aG_{3-a}\text{-Si}—(—OSiG_2)_n\text{-}(—OSiG_b(R_1)_{2-b})_m—O—SiG_{3-a}(R_1)_a$$

wherein G is hydrogen, phenyl, hydroxy, or $C_1$-$C_8$ alkyl, preferably methyl; a is 0 or an integer having a value from 1 to 3, preferably 1; b is 0, 1 or 2, preferably 1; n is a number from 0 to 1,999; m is an integer from 0 to 1,999; the sum of n and m is a number from 1 to 2,000; a and m are not both 0; $R_1$ is a monovalent radical conforming to the general formula $CqH_{2q}L$, wherein q is an integer having a value from 2 to 8 and L is selected from the following groups: $—N(R_2)CH_2—CH_2—N(R_2)_2$; $—N(R_2)_2$; $—N(R_2)_3A^-$; $—N(R_2)CH_2—CH_2—NR_2H_2A^-$; wherein $R_2$ is hydrogen, phenyl, benzyl, or a saturated hydrocarbon radical, preferably an alkyl radical from $C_1$ to $C_{20}$; $A^-$ is a halide ion.

Alternatively, the fluid substance F may be a liquid detergent composition, wherein the liquid detergent composition comprises a surfactant system as set out above and comprise at least one active selected from the group consisting of: amphiphilic alkoxylated polyalkyleneimine, cyclic polyamine or oligoamine, salt, hydrotrope, organic solvent, and mixtures thereof.

Exemplary Packaging Materials

A variety of thermoplastic materials or rigid and semi-rigid materials may be used for the packaging system 1, the pump dispenser 100, the pump assembly 50, the flexible pouch 60, the connecting shell 30, and other components of the packaging system 1 or the pump dispenser 100 herein. For example, rigid and semi-rigid materials may include, but are not limited to, metals, including but not limited to, aluminum, magnesium alloy, steel; glass; including but not limited to, laminates and polymeric materials such as polypropylene (PP), polyethylene (PE), polystyrene (PS), polyethylene-terephthalate (PET), styrene-acrylonitrile copolymer (SAN), polyethylene-terephthalate copolymers, polycarbonate (PC), polyamides, acrylonitrile-butadiene-styrene (ABS), thermoplastic elastomers, polyoxymethylene copolymer and mixtures thereof.

Any of the aforementioned polyolefins could be sourced from bio-based feedstocks, such as sugarcane or other agricultural products, to produce a bio-polypropylene or bio-polyethylene.

Other suitable thermoplastic materials include renewable polymers such as nonlimiting examples of polymers produced directly from organisms, such as polyhydroxyalkanoates (e.g., poly (beta-hydroxyalkanoate), poly (3-hydroxybutyrate-co-3-hydroxyvalerate, NODAX (Registered Trademark)), and bacterial cellulose; polymers extracted from plants, agricultural and forest, and biomass, such as polysaccharides and derivatives thereof (e.g., gums, cellulose, cellulose esters, chitin, chitosan, starch, chemically modified starch, particles of cellulose acetate), proteins (e.g., zein, whey, gluten, collagen), lipids, lignins, and natural rubber; thermoplastic starch produced from starch or chemically modified starch and polymers derived from naturally sourced monomers and derivatives, such as bio-polyethylene, bio-polypropylene, polytrimethylene terephthalate, polylactic acid, NYLON 11, alkyd resins, succinic acid-based polyesters, and bio-polyethylene terephthalate.

The suitable thermoplastic materials may include a blend or blends of different thermoplastic materials. For example, the blend may be a combination of materials derived from virgin bio-derived or petroleum-derived materials, or recycled materials of bio-derived or petroleum-derived materials. One or more of the thermoplastic materials in a blend may be biodegradable. Thermoplastic materials may be biodegradable.

The thermoplastic material may also be, for example, a polyester. Exemplary polyesters include, but are not limited to, polyethylene terephthalate (PET). The PET polymer could be sourced from bio-based feedstocks, such as sugarcane or other agricultural products, to produce a partially or fully bio-PET polymer. Other suitable thermoplastic materials include copolymers of polypropylene and polyethylene, and polymers and copolymers of thermoplastic elastomers, polyester, polystyrene, polycarbonate, poly (acrylonitrile-butadiene-styrene), poly (lactic acid), bio-based polyesters such as poly (ethylene furanate) polyhydroxyalkanoate, poly (ethylene furanoate), (considered to be an alternative to, or drop-in replacement for, PET), polyhydroxyalkanoate, polyamides, polyacetals, ethylene-alpha olefin rubbers, and styrene-butadiene-styrene block copolymers. The thermoplastic material may also be a blend of multiple polymeric and non-polymeric materials. The thermoplastic material may be, for example, a blend of high, medium, and low molecular polymers yielding a multi-modal or bi-modal blend. The multi-modal material may be designed in a way that results in a thermoplastic material that has superior flow properties yet has satisfactory chemo/physical properties. The thermoplastic material may also be a blend of a polymer with one or more small molecule additives. The small molecule could be, for example, a siloxane or other lubricating molecule that, when added to the thermoplastic material, improves the flowability of the polymeric material.

Polymeric materials may also include various fillers known to the skilled artisan, such as, for example, mica, interference pigments, wood flour; or materials that are capable of "blooming" to the surface of a molded component. Other additives may include inorganic fillers such calcium carbonate, calcium sulfate, talcs, clays (e.g., nanoclays), aluminum hydroxide, calcium silicate ($CaSiO_3$), glass formed into fibers or microspheres, crystalline silicas (e.g., quartz, novacite, crystallobite), magnesium hydroxide, mica, sodium sulfate, lithopone, magnesium carbonate, iron oxide, metal flakes; or, organic fillers such as rice husks, straw, hemp fiber, wood flour, or wood, bamboo or sugarcane fiber.

The pump dispenser 100, the flexible pouch 60 and the pump assembly 50, and other components of the packaging system 1 herein may be preferably disposable and recyclable. The packaging system 1 or the pump dispenser 100 may be made of a sustainable material selected from the group consisting of a recycled material and a renewable material.

Examples of renewable materials include bio-polyethylene, bio-polyethylene terephthalate, and bio-polypropylene. As used herein and unless otherwise noted, "polyethylene" encompasses high density polyethylene (HDPE), low density polyethylene (LDPE), linear low density polyethylene (LLDPE), and ultra-low density polyethylene (ULDPE). As used herein and unless otherwise noted, "polypropylene" encompasses homopolymer polypropylene, random copolymer polypropylene, and block copolymer polypropylene.

As used herein, "recycled" materials encompass post-consumer recycled (PCR) materials, post-industrial recycled (PIR) materials, and a mixture thereof. The pump dispenser 100 or pump assembly 50 may be composed of recycled high density polyethylene, recycled polyethylene terephthalate, recycled polypropylene, recycled LLDPE, or recycled LDPE, preferably recycled high density polyethylene, recycled polyethylene terephthalate, or recycled polypropylene, more preferably recycled high density polyethylene or recycled polyethylene terephthalate.

The sustainable material may contain one or more bio-derived polymers or plastics selected from the group consisting of bio-derived polyethylene, bioderived high-density polyethylene, bio-derived polypropylene, bio-derived polyethylene terephthalate, and mixtures thereof, see for instance CA2762589A1, which is incorporated herein by reference.

However, the pump dispenser 100 or pump assembly 50 may be substantially free, preferably free of a plastic polymeric material selected from the group consisting of polyethylene, polypropylene, polyethylene terephthalate, polyester, polyamide, polystyrene, polyvinyl chloride, and mixtures thereof.

Methods

A method of dispensing a fluid substance F contained in a flexible pouch 60 of a pump dispenser 100 as disclosed hereinbefore is provided and comprises the following steps, preferably in that order:

a) providing a pump assembly 50, wherein the pump assembly 50 includes an actuator 10 and a closure 20 connected to the actuator 10;
b) optionally providing a sealing piece 40 and inserting the sealing piece 40 at a port 56 of a pump assembly 50;
c) providing a connecting shell 30 and engaging the connecting shell 30 to the closure 20 of the pump assembly 50;
d) providing the flexible pouch 60 comprising the fluid substance F;
e) securing the flexible pouch 60 to the pump assembly 50 and the connecting shell 30, wherein a lower portion 320 of the connecting shell 30 is removably engaged with an outer surface 612 of the spout 61 of the flexible pouch 60; and wherein the pump assembly 50 is removably engaged with the flexible pouch 60 in an airtight sealing manner;
f) triggering and releasing the actuator 10 of the pump assembly 50, such that air does not flow back to the flexible pouch 60, wherein the flexible pouch 60 is airtight and/or gradually vacuumed over dispensing usage, and the flexible pouch 60 shrinks when the fluid substance F is expelled out of the pump dispenser 100.

The sealing piece 40 may ensure that air flows not back to the flexible pouch 60. Optionally, air may flow from an air ventilating hole (511, 511') of an housing (51, 51') of the pump assembly 50 to an air chamber (330, 513'), The closure 20 of the pump assembly 50 may be coupled to a neck 31 of the connecting shell 30. The closure 20 of the pump assembly 50 may be threadingly engaged with the neck 31 of the connecting shell 30. The closure 20 may have inner threads 210. The inner threads 210 of the closure 20 may engage with the outer threads 311 of the neck 31 of the connecting shell 30 to secure the pump assembly 50 to the connecting shell 30.

The lower portion 320 of the connecting shell 30 is removably engaged with the outer surface 612 of the spout 61 of the flexible pouch 60. The connecting shell 30 has the lower end 321 at the lower portion 320 of the connecting shell 30. In that instance, the lower end 321 of the connecting shell 30 may be removably engaged with the outer surface 612 of the spout 61 of the flexible pouch 60. Namely, the lower end 321 of the connecting shell 30 may be in interference with the outer surface 612 of the spout 61 of the flexible pouch 60.

The pump assembly 50 is removably engaged with the flexible pouch 60 in an airtight scaling manner. In that example, the port 56 of the pump assembly 50 is removably engaged with the inner surface 611 of the spout 61 of the flexible pouch 60 in an airtight sealing manner. As said above, the housing 51 of the pump assembly 50 has the port 56 at the lower end 520 of the housing 51. In that example, the port 56 of the pump assembly 50 may be in interference with the inner surface 611 of the spout 61 of the flexible pouch 60 in an airtight sealing manner.

Test Methods

It is understood that the Test Methods that are disclosed in the Test Methods Section of the present application should be used to determine the respective values of the parameters of as described and claimed herein.

Viscosity Measurement

The viscosity of the fluid substance F is measured by a Cone/Plate Brookfield DV12T, by Brookfield Engineering Laboratories, Stoughton, MA. The cone used (Spindle CPA-41z) has a diameter of 24 mm and 3° angle. The viscosity is determined using a steady state flow experiment at constant shear rate of 2 $s^{-1}$ and at temperature of 26.5 °C. The sample size is 2.5 mL.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A packaging system for storing a fluid substance comprising a pump dispenser, wherein the pump dispenser comprises a pump assembly, a flexible pouch and a connecting shell;

wherein the flexible pouch contains a fluid substance to be dispensed, wherein the flexible pouch has a spout; wherein the spout is a sleeve having inner and outer surfaces;

wherein the connecting shell has a cavity therein, wherein the connecting shell has an upper portion and a lower portion having a lower end;

wherein the pump assembly includes an actuator having a cavity therein; and a closure connected to the actuator;

wherein the pump assembly has a housing having an outer surface and a lower end;

wherein the housing of the pump assembly is secured at the upper portion of the connecting shell, wherein the cavity of the connecting shell and the outer surface of the housing of the pump assembly form an air chamber or wherein the cavity of the housing forms an air chamber;

wherein the housing of the pump assembly includes an air ventilating hole;

wherein the housing of the pump assembly has a port at the lower end of the housing;

wherein the lower portion of the connecting shell is removably engaged with the outer surface of the spout of the flexible pouch, and characterized in that the pump assembly is removably engaged with the flexible pouch in an airtight sealing manner;

wherein the port of the pump assembly is removably engaged with the inner surface of the spout of the flexible pouch in an airtight sealing manner, and wherein the connecting shell comprises a sealing piece positioned around the port of the pump assembly at the spout of the flexible pouch, the sealing piece configured to provide an airtight seal between the spout and the port of the pump assembly and provide an additional airtight barrier between the lower end of the connecting shell and the outer surface of the spout of the flexible pouch;

such that when the actuator is pushed down and released by a user, air is balanced in the air chamber by the air ventilating hole and air is not balanced in the flexible pouch, wherein the flexible pouch is airtight and/or gradually vacuumed over dispensing usage.

2. The packaging system of claim 1, such that when the actuator is pushed down and released by a user, air is balanced in the air chamber by the air ventilating hole and air is not balanced in the flexible pouch, wherein the flexible pouch is gradually vacuumed over dispensing usage.

3. The packaging system of claim 2, wherein the sealing piece is at a location where the port of the pump assembly is removably engaged with the spout of the flexible pouch such that the spout and the pump assembly are engaged in the airtight sealing manner.

4. The packaging system of claim 1, wherein the lower portion of the connecting shell has a lower end, wherein the lower end of the connecting shell comprises inner threads, wherein the spout of the flexible pouch comprises outer threads on the outer surface, wherein the inner threads of the lower end of the connecting shell engage with the outer threads of the spout of the flexible pouch to removably secure the connecting shell to the flexible pouch.

5. The packaging system of claim 1, wherein the port of the pump assembly comprises an outer surface, wherein the port of the pump assembly comprises outer threads on the outer surface, wherein the spout of the flexible pouch comprises inner threads on the inner surface, wherein the outer threads of the port of the pump assembly engage with the inner threads of the spout of the flexible pouch to removably secure the pump assembly to the flexible pouch in airtight sealing manner.

6. The packaging system of claim 1, wherein the packaging system further comprises an outer case for storing the pump dispenser and the flexible pouch.

7. The packaging system of claim 6, wherein the outer case has a front panel including a front opening for the introduction of the pump dispenser such that the flexible pouch is stored inside the outer case.

8. The packaging system of claim 6, wherein the outer case has a top panel having an opening such that the pump dispenser is detachably secured to the outer case.

9. The packaging system of claim 8, wherein the connecting shell has a fixative element to snap into the opening of the top panel of the outer case.

10. The packaging system of claim 1, wherein the pump assembly is selected from the group consisting of a liquid pump assembly, and a foaming pump assembly.

11. The packaging system of claim 1, wherein the pump dispenser does not include any dip tube and wherein the fluid substance has a viscosity from 1 mPa·s (1 cps) to 5 Pa·s (5000 cps).

12. The packaging system of claim 1, wherein the pump dispenser includes a dip tube and wherein the fluid substance has a viscosity from 6 Pa·s (6000 cps) to 200 Pa·s (200000 cps).

13. The packaging system of claim 1, wherein the fluid substance to be dispensed from the flexible pouch is a cleaning composition to be applied on skin when the cleaning composition is in the form of a personal care product being a shower or bath cream, a body wash or a foaming body wash.

14. A pump dispenser comprising a pump assembly, a flexible pouch and a connecting shell;

wherein the flexible pouch contains a fluid substance to be dispensed, wherein the flexible pouch has a spout; wherein the spout is a sleeve having inner and outer surfaces;

wherein the connecting shell has a cavity therein, wherein the connecting shell has an upper portion and a lower portion having a lower end;

wherein the pump assembly includes an actuator having a cavity therein; and a closure connected to the actuator;

wherein the pump assembly has a housing having an outer surface and a lower end;

wherein the housing of the pump assembly is secured at the upper portion of the connecting shell, wherein the cavity of the connecting shell and the outer surface of the housing of the pump assembly form an air chamber or wherein the cavity of the housing forms an air chamber;

wherein the housing of the pump assembly includes an air ventilating hole;

wherein the housing of the pump assembly has a port at the lower end of the housing;

wherein the lower portion of the connecting shell is removably engaged with the outer surface of the spout of the flexible pouch, and characterized in that the pump assembly is removably engaged with the flexible pouch in an airtight sealing manner;

wherein the port of the pump assembly is removably engaged with the inner surface of the spout of the flexible pouch in an airtight sealing manner, and wherein the connecting shell comprises a sealing piece positioned around the port of the pump assembly at the spout of the flexible pouch, the sealing piece configured to provide an airtight seal between the spout and the port of the pump assembly and provide an additional airtight barrier between the lower end of the connecting shell and the outer surface of the spout of the flexible pouch;

such that when the actuator is pushed down and released by a user air is balanced in the air chamber by the air ventilating hole; and air is not balanced in the flexible pouch, wherein the flexible pouch is airtight and/or gradually vacuumed over dispensing usage.

15. A method of dispensing a fluid substance contained in a flexible pouch of the pump dispenser of claim 14 comprising the following steps:

a) providing the pump assembly, wherein the pump assembly includes the actuator and the closure connected to the actuator;

b) providing the sealing piece and inserting the sealing piece at a port of a pump assembly;

c) providing the connecting shell and engaging the connecting shell to the closure of the pump assembly;

d) providing the flexible pouch comprising the fluid substance;

e) securing the flexible pouch to the pump assembly and the connecting shell, wherein the lower portion of the connecting shell is removably engaged with the outer surface of the spout of the flexible pouch; and wherein the pump assembly is removably engaged with the flexible pouch in an airtight sealing manner;

f) triggering and releasing the actuator of the pump assembly, such that air does not flow back to the flexible pouch, wherein the flexible pouch is airtight and/or gradually vacuumed over dispensing usage, and the flexible pouch shrinks when the fluid substance F is expelled out of the pump dispenser.

* * * * *